US011065529B2

(12) United States Patent
Ortwig

(10) Patent No.: US 11,065,529 B2
(45) Date of Patent: Jul. 20, 2021

(54) METHOD OF AND APPARATUS FOR CHANGING A SHAPE OF A GLIDING SURFACE OF A GLIDING DEVICE

(71) Applicant: Jan Peter Ortwig, Bowen Island (CA)

(72) Inventor: Jan Peter Ortwig, Bowen Island (CA)

( * ) Notice: Subject to any disclaimer, the term of this patent is extended or adjusted under 35 U.S.C. 154(b) by 0 days.

(21) Appl. No.: 16/095,498

(22) PCT Filed: Apr. 21, 2017

(86) PCT No.: PCT/CA2017/050502
§ 371 (c)(1),
(2) Date: Oct. 22, 2018

(87) PCT Pub. No.: WO2017/181292
PCT Pub. Date: Oct. 26, 2017

(65) Prior Publication Data

US 2019/0126129 A1 May 2, 2019

Related U.S. Application Data

(60) Provisional application No. 62/326,561, filed on Apr. 22, 2016.

(51) Int. Cl.
*A63C 5/00* (2006.01)
*A63C 5/07* (2006.01)
(Continued)

(52) U.S. Cl.
CPC ..... *A63C 5/07* (2013.01); *A63C 5/044* (2013.01); *A63C 5/06* (2013.01)

(58) Field of Classification Search
CPC ..... A63C 5/003; A63C 5/07; A63C 5/044; A63C 5/06
See application file for complete search history.

(56) References Cited

U.S. PATENT DOCUMENTS 3,549,162 A 12/1970 Coutts
3,921,994 A 11/1975 Locati
(Continued)

FOREIGN PATENT DOCUMENTS

AT 238074 1/1965
AT 504 801 A1 8/2008
(Continued)

OTHER PUBLICATIONS

International Search Report and Written Opinion dated Aug. 21, 2017, issued in corresponding International Application No. PCT/CA2017/050502, filed Apr. 21, 2017, 8 pages.

*Primary Examiner* — Hau V Phan

(74) *Attorney, Agent, or Firm* — Christensen O'Connor Johnson Kindness PLLC

(57) ABSTRACT

A method of changing a shape of a gliding surface of a gliding device may involve, in response to longitudinal deflection of the gliding device, causing at least one force transfer element to move longitudinally relative to the gliding device. Causing the at least one force transfer element to move longitudinally relative to the gliding device may involve causing the at least one force transfer element to deflect first and second laterally opposite side elements of the gliding device along a portion of the gliding device extending longitudinally along a binding region of the gliding device. Apparatuses and gliding devices are also disclosed.

16 Claims, 23 Drawing Sheets

(51) Int. Cl.
*A63C 5/044* (2006.01)
*A63C 5/06* (2006.01)

(56) References Cited

U.S. PATENT DOCUMENTS

| | | | | |
|---|---|---|---|---|
| 5,167,424 | A * | 12/1992 | Baggio | A63C 5/075 267/141 |
| 5,211,418 | A * | 5/1993 | Scherubl | A63C 5/075 188/381 |
| 5,551,728 | A | 9/1996 | Barthel et al. | |
| 5,765,854 | A * | 6/1998 | Moore | A63C 5/03 280/14.23 |
| 5,785,342 | A * | 7/1998 | Bronson | A63C 5/075 280/602 |
| 6,102,428 | A | 8/2000 | Bobrowicz | |
| 7,014,206 | B2 | 3/2006 | Donze | |
| 7,207,346 | B2 * | 4/2007 | Park | F23N 5/247 137/543 |
| 7,344,148 | B2 | 3/2008 | Donze et al. | |
| 7,654,554 | B1 * | 2/2010 | Scaturro | A63C 5/03 280/14.21 |
| 8,246,070 | B2 * | 8/2012 | Lin | A63C 5/03 280/11.14 |
| 2004/0119264 | A1 | 6/2004 | Vallet et al. | |
| 2005/0006875 | A1 | 1/2005 | Donze et al. | |
| 2008/0073875 | A1 | 3/2008 | Krafft | |
| 2008/0106069 | A1 | 5/2008 | Holzer et al. | |
| 2008/0179872 | A1 | 7/2008 | Guex et al. | |
| 2008/0185815 | A1 | 8/2008 | Riepler et al. | |
| 2008/0185816 | A1 | 8/2008 | Riepler et al. | |
| 2009/0008906 | A1 | 1/2009 | Karlsen | |
| 2009/0261544 | A1 | 10/2009 | Holzer | |
| 2011/0001305 | A1 | 1/2011 | Huber et al. | |
| 2011/0248457 | A1 * | 10/2011 | Kosmehl | A63C 5/003 280/14.22 |
| 2013/0059492 | A1 | 3/2013 | Ortwig | |

FOREIGN PATENT DOCUMENTS

| | | | |
|---|---|---|---|
| DE | 84 22 316 | U1 | 11/1984 |
| DE | 101 52 438 | A1 | 4/2003 |
| DE | 602 04 905 | T2 | 5/2006 |
| DE | 601 19 961 | T2 | 12/2006 |
| DE | 10 2007 055 532 | A1 | 5/2009 |
| EP | 1 297 869 | A1 | 4/2003 |
| EP | 1 430 935 | A1 | 6/2004 |
| EP | 1 902 758 | A1 | 3/2008 |
| EP | 1 946 804 | A1 | 7/2008 |
| EP | 1 952 854 | A1 | 8/2008 |
| EP | 1 952 855 | A1 | 8/2008 |
| EP | 2 072 095 | A1 | 6/2009 |
| EP | 2 552 558 | B1 | 3/2016 |
| FR | 2 794 374 | A1 | 12/2000 |
| FR | 2 848 465 | A1 | 6/2004 |
| FR | 2 848 466 | A1 | 6/2004 |
| FR | 2 906 153 | A1 | 3/2008 |
| FR | 2 911 285 | A1 | 7/2008 |
| FR | 2 986 436 | A1 | 8/2013 |
| WO | 91/16957 | A1 | 11/1991 |
| WO | 02/40115 | A1 | 5/2002 |
| WO | 03/039686 | A1 | 5/2003 |
| WO | 2011/120516 | A2 | 10/2011 |
| WO | 2011/123950 | A1 | 10/2011 |

* cited by examiner

METHOD OF AND APPARATUS FOR CHANGING A SHAPE OF A GLIDING SURFACE OF A GLIDING DEVICE

CROSS-REFERENCE TO RELATED APPLICATION

This application claims the benefit of, and priority to, U.S. provisional patent application No. 62/326,561 filed Apr. 22, 2016, the entire contents of which are incorporated by reference herein.

FIELD

This disclosure relates generally to gliding devices such as skis and snowboards, for example.

BACKGROUND

In gliding devices, such as skis and snowboards for example, stiffness may be desirable. However, increasing stiffness in a gliding device may add weight to the gliding device, and such additional weight may be undesirable.

SUMMARY

Embodiments such as those described herein may be described as Omnidirectional progressive Ski performance Control systems (or "OSCs") for gliding devices, such as skis and snowboards for example, and may also involve active dynamic lateral transitional modulation of a gliding device, such as a ski or snowboard for example, and its performance characteristics in terms of longitudinal flex, edge attack angle, attenuation (such as vibration reduction or dampening) by modulation of its lateral profile towards concavity or towards convexity partially, sequentially, and/or over its full length.

According to one embodiment, there is disclosed a method of changing a shape of a gliding surface of a gliding device, the method comprising: in response to longitudinal deflection of the gliding device, causing at least one force transfer element to move longitudinally relative to the gliding device; wherein causing the at least one force transfer element to move longitudinally relative to the gliding device comprises causing the at least one force transfer element to deflect first and second laterally opposite side elements of the gliding device along a portion of the gliding device extending longitudinally along a binding region of the gliding device.

According to another embodiment, there is disclosed an apparatus for changing a shape of a gliding surface of a gliding device, the apparatus comprising: a means for causing at least one force transfer element to move longitudinally relative to the gliding device in response to longitudinal deflection of the gliding device; and a means for causing the at least one force transfer element to deflect first and second laterally opposite side elements of the gliding device, along a portion of the gliding device extending longitudinally along a binding region of the gliding device, in response to moving longitudinally relative to the gliding device. According to another embodiment, there is disclosed an gliding device comprising: a gliding surface; first and second laterally opposite side elements, each comprising a respective portion of the gliding surface; at least one force transfer element; a means for causing the at least one force transfer element to move longitudinally relative to the gliding device in response to longitudinal deflection of the gliding device; and a means for changing a shape of the gliding surface, along a portion of the gliding device extending longitudinally along a binding region of the gliding device, in response to longitudinal movement of the at least one force transfer element relative to the gliding device, wherein the means for changing the shape of the gliding surface comprises a means for causing the at least one force transfer element to deflect the first and second laterally opposite side elements along the portion of the gliding device extending longitudinally along a binding region of the gliding device.

According to another embodiment, there is disclosed an apparatus for changing a shape of a gliding surface of a gliding device, the apparatus comprising: a force transfer body removably attachable to the gliding device; and at least one force transfer element configured to move longitudinally relative to the force transfer body in response to longitudinal deflection of the force transfer body; wherein the force transfer body is configured to deflect first and second laterally opposite side elements of the gliding device, along a portion of the gliding device extending longitudinally along a binding region of the gliding device, when the force transfer body is attached to the gliding device and in response to the longitudinal movement of the at least one force transfer element relative to the force transfer body.

According to another embodiment, there is disclosed a gliding device comprising: a gliding surface; first and second laterally opposite side elements, each comprising a respective portion of the gliding surface; and at least one force transfer element configured to move longitudinally relative to the gliding device in response to longitudinal deflection of the gliding device; wherein the at least one force transfer element is configured to deflect the first and second laterally opposite side elements of the gliding device, along a portion of the gliding device extending longitudinally along a binding region of the gliding device, in response to the longitudinal movement of the at least one force transfer element relative to the gliding device.

Other aspects and features will become apparent to those ordinarily skilled in the art upon review of the following description of illustrative embodiments in conjunction with the accompanying figures.

DETAILED DESCRIPTION

Figure 1:
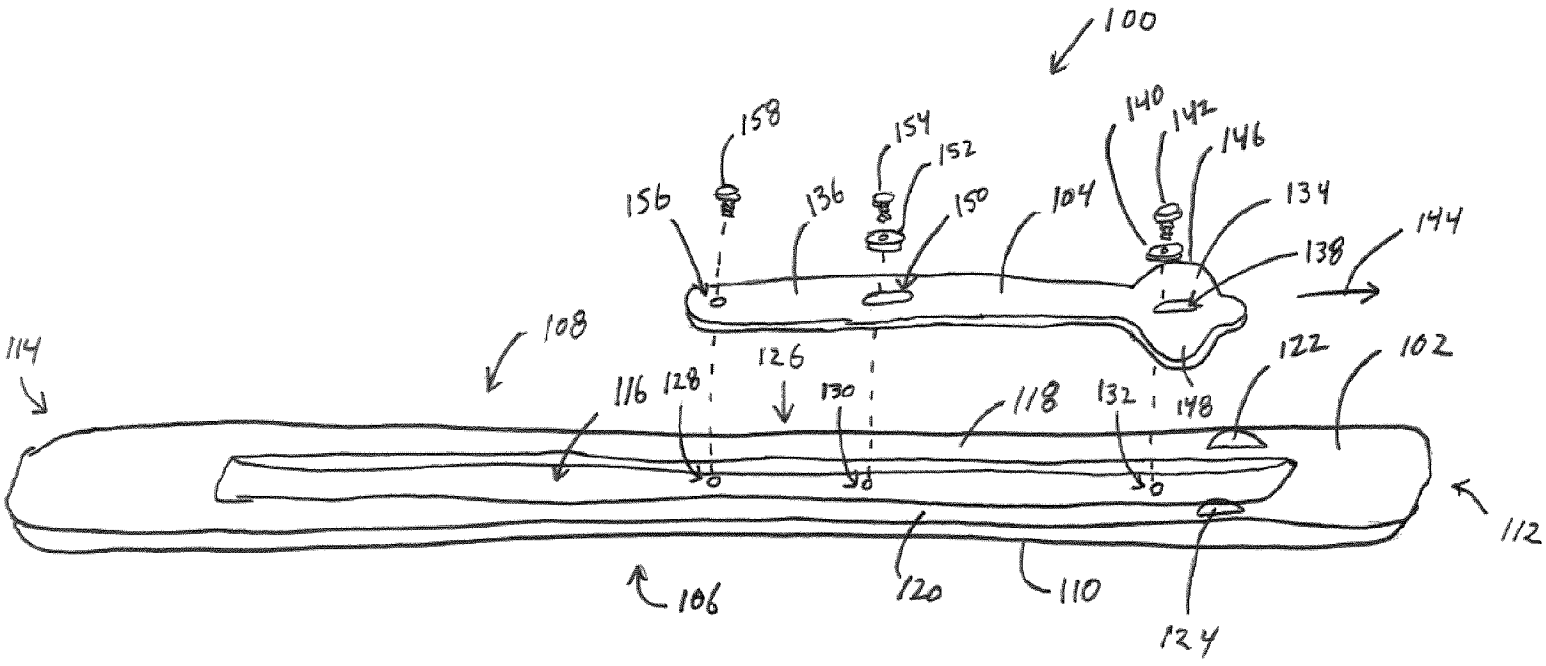
FIGS. 1 to 5 illustrate a gliding assembly according to one embodiment.

Referring to FIG. 1, a gliding assembly according to one embodiment is shown generally at 100 and includes a gliding device 102 and a force transfer body 104. The gliding device 102 is a ski having a bottom side shown generally at 106 and a top side opposite the bottom side 106 and shown generally at 108. In this context, "bottom" refers to a side that in use may contact a surface such as snow or water for example, and "top refers to a side facing upward when the bottom side contacts such a surface. The gliding device 102 has a gliding surface 110 on the bottom side 106. The gliding device 102 has a front end or tip shown generally at 112 and a rear end shown generally at 114 and opposite the front end 112.

On the top side 108, the gliding device 102 defines a longitudinal channel shown generally at 116. In this context, "longitudinal" refers to a direction extending the front end 112 and the rear end 114. The gliding device 102 includes laterally opposite side elements 118 and 120 on opposite lateral sides of the channel 116. In this context, "lateral" refers to a side of a longitudinal direction between the front end 112 and the rear end 114. The laterally opposite side elements 118 and 120 each include a respective portion of the gliding surface 110, and the laterally opposite side elements 118 and 120 have sufficient rigidity to transfer forces applied to one portion of the laterally opposite side elements 118 and 120 longitudinal along the gliding device 102 as described below. The laterally opposite side element 118 includes a projection 122 extending upwardly from the laterally opposite side element 118, and laterally opposite side element 120 includes a projection 124 extending upward from the laterally opposite side element 120. The gliding device 102 includes a binding region shown generally at 126 where a ski boot or other foot gear may be bound to the gliding device 102, and the projections 122 and 124 are on a front side of the binding region 126. In the channel 116, the gliding device 102 includes through-openings shown generally at 128,130, and 132 to receive respective fasteners as described below.

The force transfer body 104 includes a force transfer element 134 and a connecting element 136 integrally formed with the force transfer element 134. The force transfer element 134 defines a through-opening shown generally at 138 and sized to receive a gliding element 140 and a fastener 142 in the gliding element 140. The through-opening 138 defines a gliding surface positioned to contact the gliding element 140 so that when the fastener 142 is fastened in the through-opening 132, the force transfer element 134 can slide in a longitudinal direction 144 relative to the gliding device 102 while the fastener 142 holds the force transfer element 134 against the laterally opposite side elements 118 and 120. The force transfer element 134 has laterally opposite projections 146 and 148 on laterally opposite sides of the through-opening 138. The force transfer element 134 has sufficient rigidity to maintain the lateral projections 146 and 148 generally coplanar when transferring forces to the projections 122 and 124 as described below.

The connecting element 136 defines a through-opening shown generally at 150 and sized to receive a gliding element 152 and a fastener 154. The through-opening 150 defines a contact surface to contact the gliding element 152 and allow a portion of the connecting element 136 surrounding the through-opening 150 to glide relative to the gliding device 102 while the fastener 154 holds the portion of the connecting element 136 in the channel 116 when the fastener 154 is received in the through-opening 130. The connecting element 136 also defines a through-opening shown generally at 156 and sized to receive a fastener 158 such that the fastener 158 holds a portion of the connecting element 136 in a generally constant position relative to the gliding device 102 when the fastener 158 is received in the through-opening 128.

Figure 2:
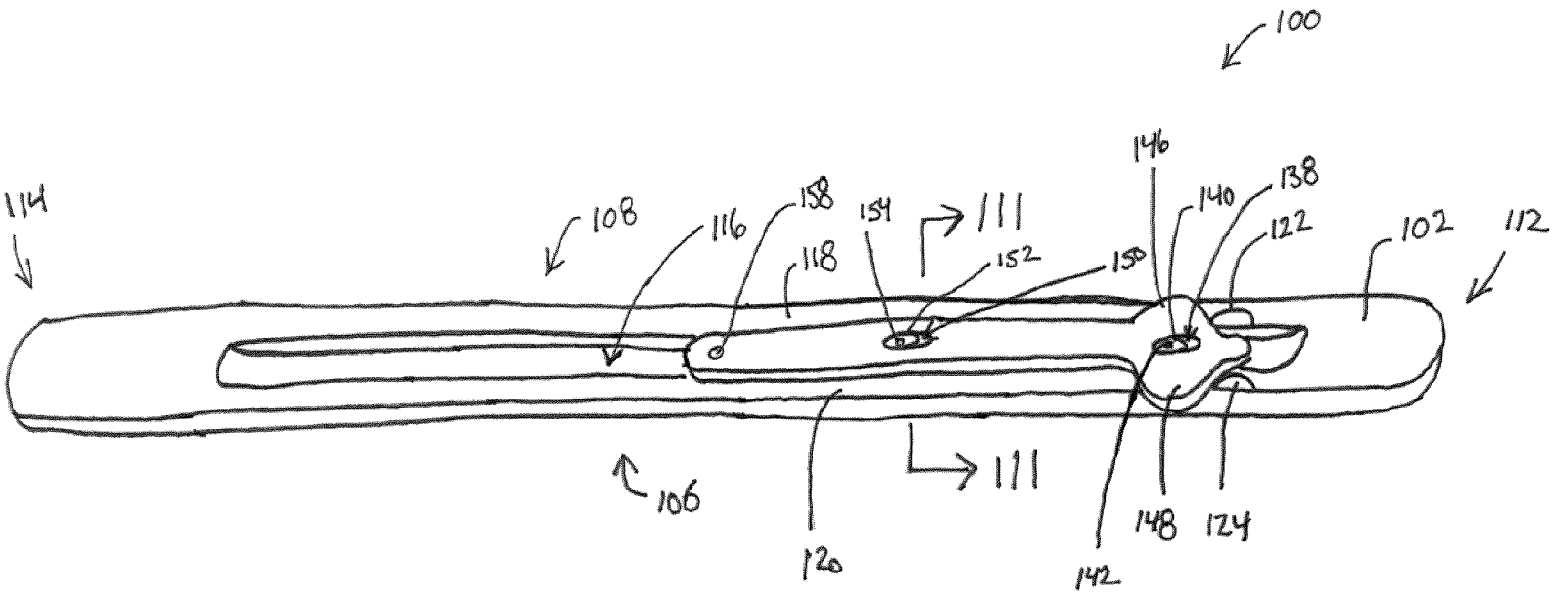

Referring to FIG. 2, the gliding assembly 100 is shown assembled as described above. When the gliding assembly 100 is assembled as shown in FIG. 2, the lateral projection 146 is adjacent the projection 122 on a rear side of the projection 122, and the lateral projection 148 is adjacent the projection 124 on a rear side of the projection 124.

Figure 3:
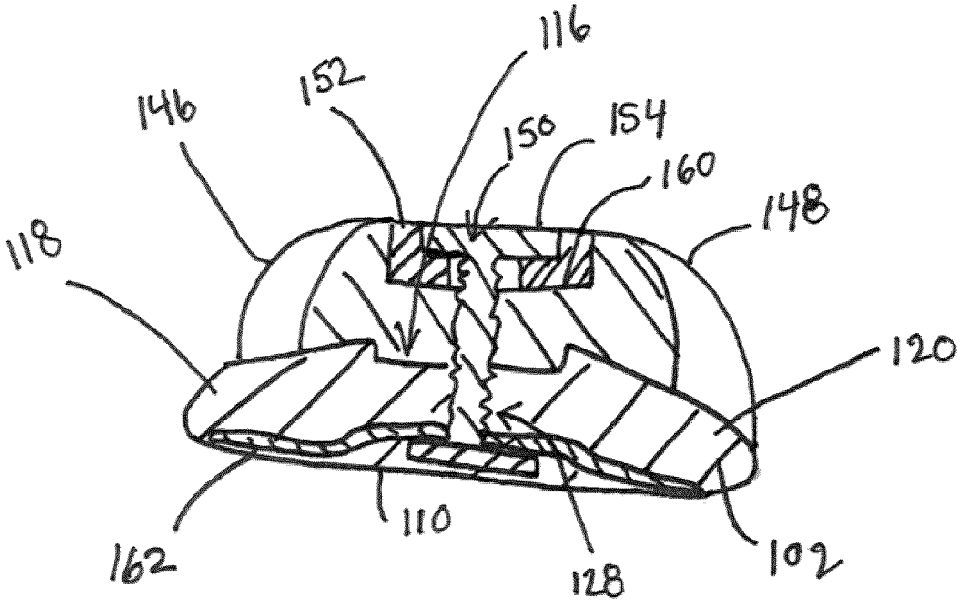

FIG. 3 illustrates the gliding element 152 and the fastener 154 received in the through-opening 150. The gliding element 152 contacts a gliding surface 160 in the through-opening 150 as described above. The fastener 154 is received in the through-opening 128 and fastened to a titanal inlay 162 in the gliding device 102.

Figure 4:
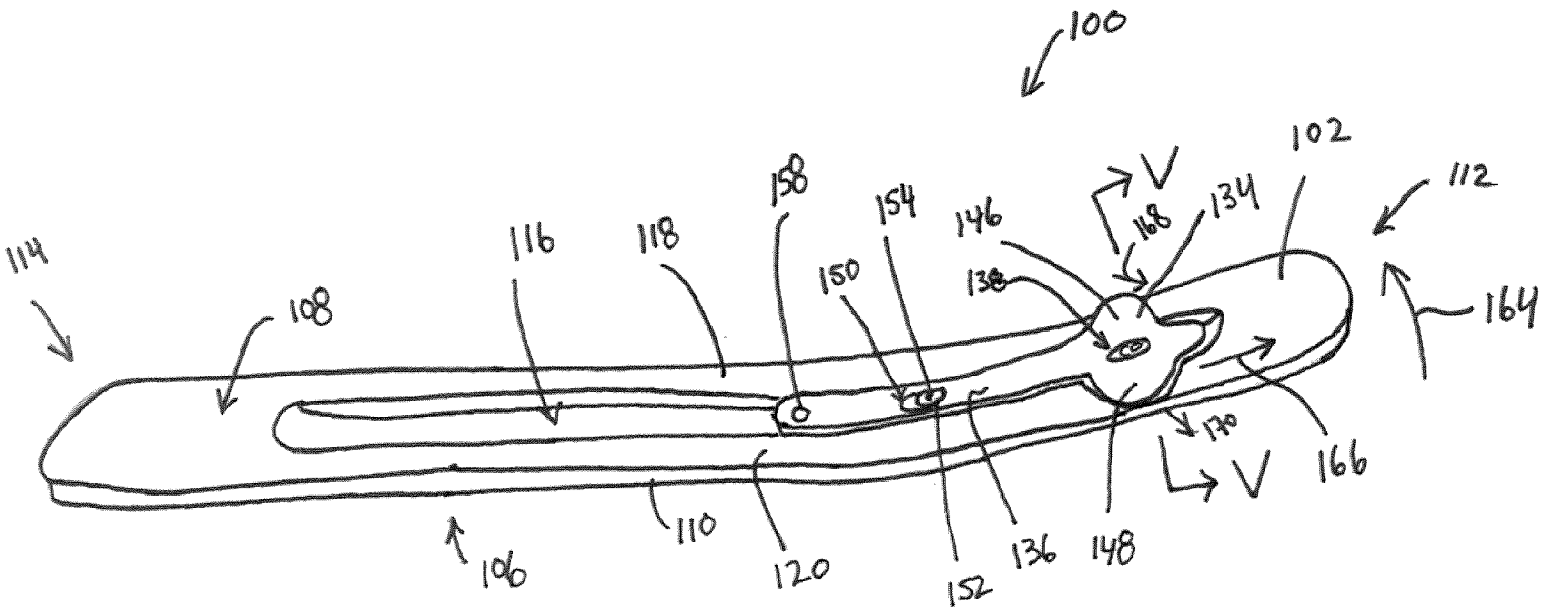

Referring to FIG. 4, the front end 112 of the gliding device 102 may be deflected longitudinally in a direction 164. The longitudinal deflection in the direction 164 is in a direction opposite the gliding surface 110. In response to such longitudinal deflection, the gliding device 102 and the connecting element 136 curve along different curvatures because the connecting element 136 is on the top side 108 of the gliding device 102. Because the gliding device 102 and the connecting element 136 curve along different curvatures, and because the fastener 158 holds a portion of the connecting element 136 surrounding the fastener 158 in a generally constant position relative to the gliding device 102, longitudinal deflection of the gliding device 102 in the direction 164 causes the force transfer element 134 to move longitudinally relative to the gliding device 102 in a direction 166 toward the front end 112.

Figure 5:
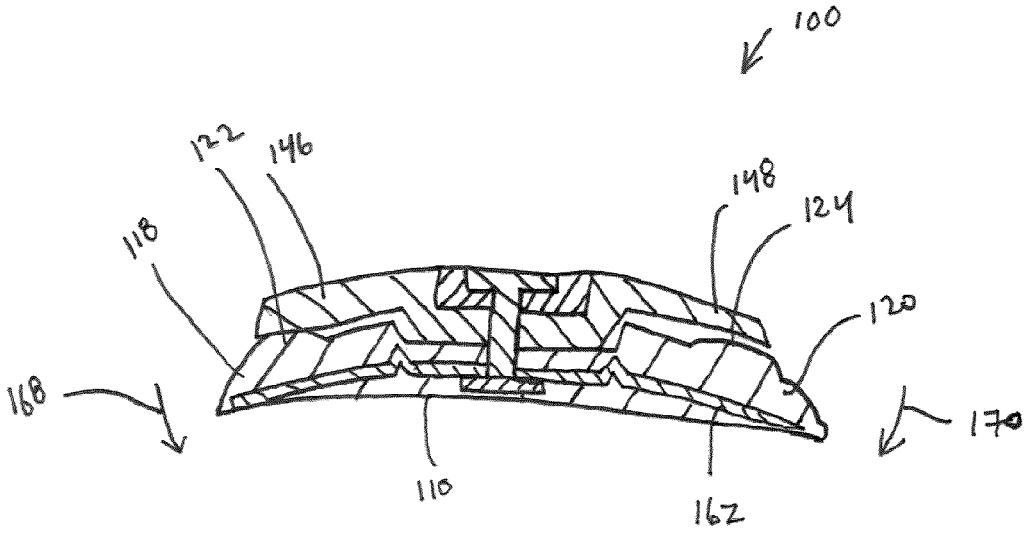

When the force transfer element 134 moves in the direction 166, the lateral projections 146 and 148 contact tapered surfaces of the projections 122 and 124. As indicated above, the force transfer element 134 has sufficient rigidity to maintain the lateral projections 146 and 148 generally planar, so as the force transfer element 134 moves in the direction 166, the lateral projections 146 and 148 transfer forces to the projections 122 and 124 in directions 168 and 170 respectively toward the gliding surface 110, as shown in FIG. 5. The projections 122 and 124 transfer forces from the lateral projections 146 and 148 to other portions of the laterally opposite side elements 118 and 120 respectively. As indicated above, the laterally opposite side elements 118 and 120 have sufficient rigidity to transfer forces from the projections 122 and 124 longitudinally along at least a portion of the gliding device 102. In some embodiments, forces from the projections 122 and 124 may be transferred along an entire length of the gliding device 102, or along a portion of the gliding device 102 such as a portion having approximately two thirds of the length of the gliding device 102.

As indicated above, the laterally opposite side elements 118 and 120 include respective portions of the gliding surface 110, so that movement of the laterally opposite side elements 118 and 120 in the directions 168 and 170 respectively imparts a concave shape to the gliding surface 110 as shown in FIG. 5. The concave shape may be imparted along an entire length of the gliding device 102 or along a portion of the length of the gliding device 102, and the concave shape may be imparted at least along the binding region 126.

Figure 6:
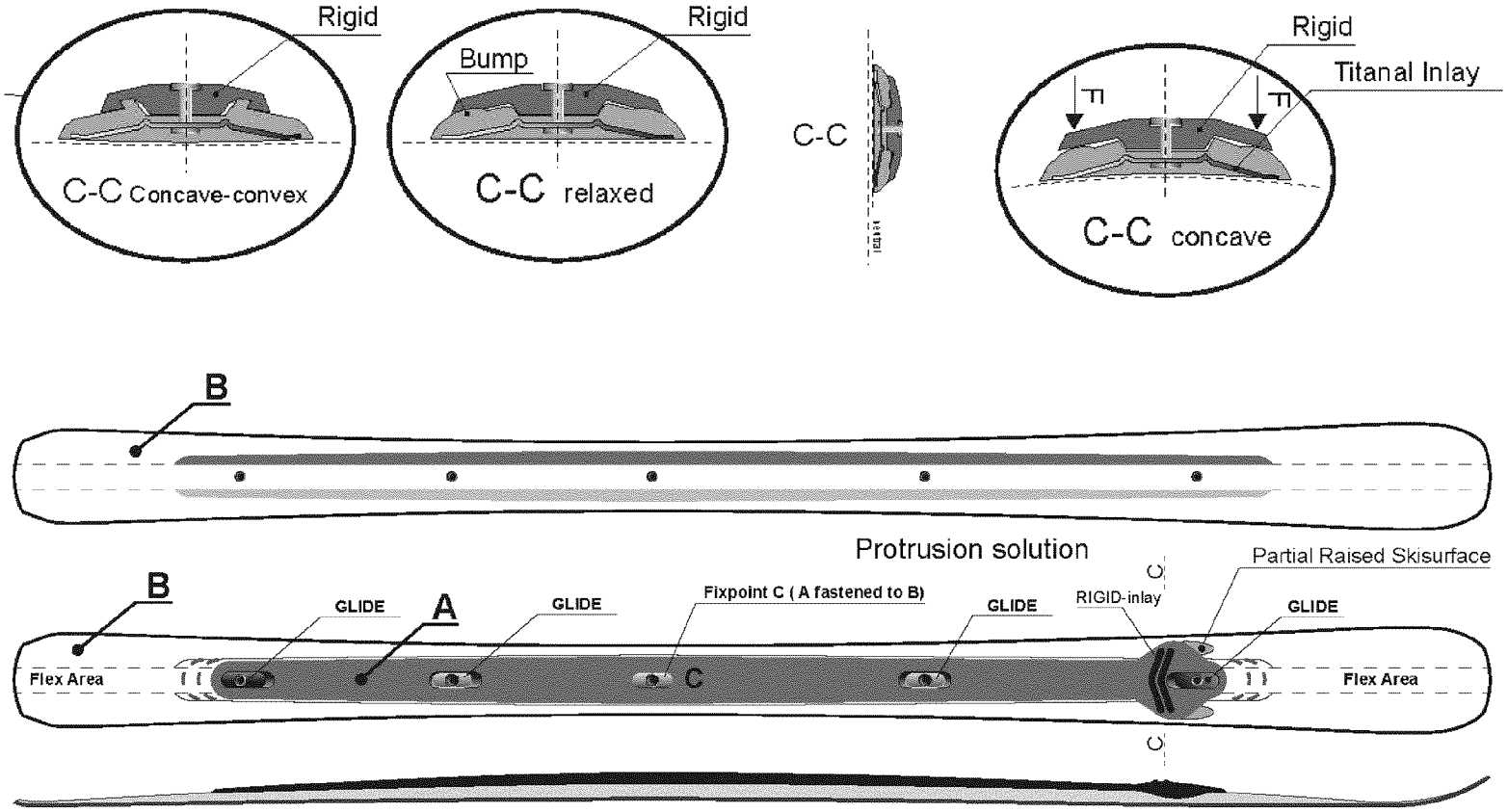
FIG. 6 illustrates gliding assemblies according to embodiments including the embodiment of FIGS. 1 to 5.

FIG. 6 is an illustration of embodiments including the gliding assembly 100, and an illustration of some below some basic working principles of Omnidirectional progressive Ski performance Control systems (or "OSCs") according to some embodiments. In embodiments such as the gliding assembly 100 for example, forced lateral transitional concavity and/or convexity may be applied partially, sequentially, and/or over a full length of a gliding device, such as a ski or snowboard for example, generating dynamic progressive flex control, torsion control, and/or control of vibration using a force resulting out of a difference of movement of two eccentrically positioned bodies A (which may be a relatively simple one-piece actuator or OSC module) and B fastened to each other at a fixed point C as shown in FIG. 6. In FIG. 6 and in other drawings, "F" together with an arrow indicates a force generally in the direction of the arrow. In some embodiments, the fixed point C can be moved along the longitudinal axis of the ski B to change characteristics. In the embodiments of FIG. 6, such a force may be used to apply pressure on a top of the ski, bending a lateral profile of the ski as shown in FIG. 6.

FIG. 6 illustrates (at "C-C concave") an embodiment in which lateral movement of a force transfer element imparts concavity to the gliding surface of the ski by moving the force transfer element over bumps or partially raised surfaces on the top of the ski. FIG. 6 also illustrates (at "C-C Concave-convex") an embodiment in which lateral movement of a force transfer element imparts convexity to the gliding surface of the ski. In such an embodiment, the force transfer element includes inward-facing surfaces that generally remain a constant distance apart from each other, and that move along surfaces of the ski that are angled acutely relative to a longitudinal axis of the ski to have lateral separation distances from each other that vary longitudinally. As the force transfer element moves longitudinally along such surfaces of the ski, such surfaces of the ski may be moved closer together, which may impart a convex shape to the gliding surface of the ski.

In the embodiments of FIG. 6, the body B is fastened to a longitudinal center of the ski partially by gliding fasteners in combination with long-oval washers and standoff bolts of an in-ski integrated titanal inlay profile, which may cause the lateral profile of the ski to return resiliently to a flat shape after lateral deformation. In the embodiment of FIG. 6, a lateral homogenous flex area is shown between dashed lines. Also, in the embodiment of FIG. 6, the actuator A may create concavity, convexity, or both, at a front of the ski, but alternative embodiments may differ, as described herein for example.

Figure 7:
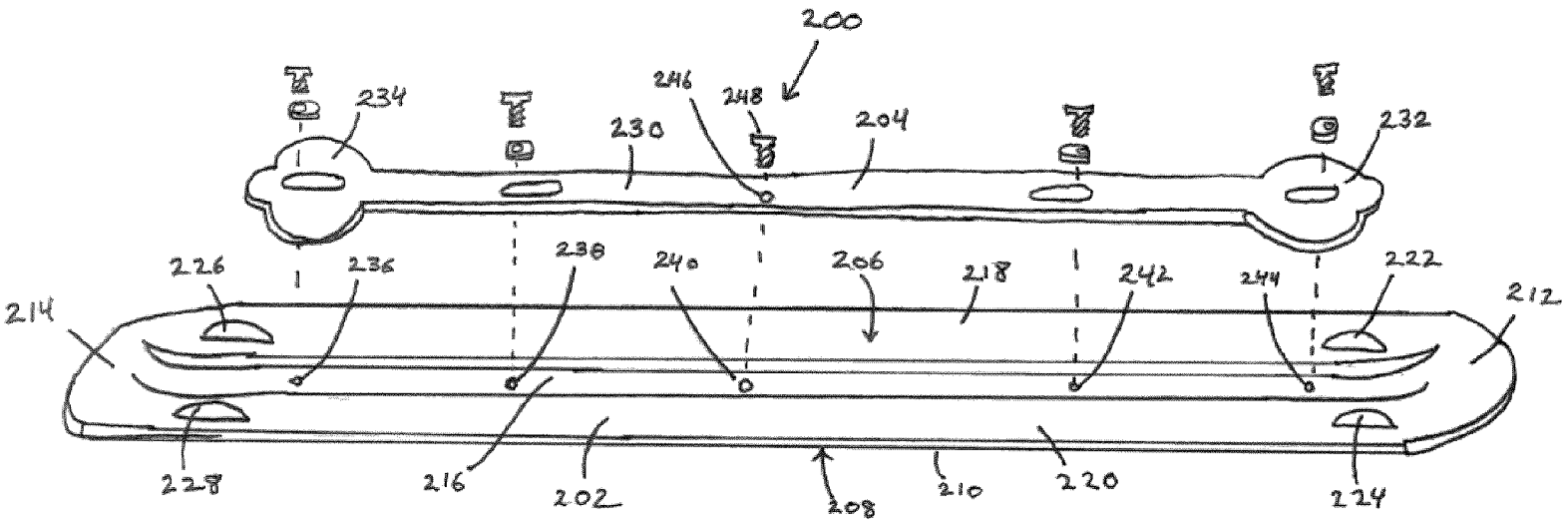
FIG. 7 illustrates a gliding assembly according to another embodiment.

Referring to FIG. 7, a gliding assembly according to another embodiment and similar to the embodiment described in reference to FIGS. 1-5 is shown generally at 200. Gliding assembly 200 comprises a gliding device 202 and a force transfer body 204.

The gliding device 202 is substantially similar to gliding device 102 described in reference to FIGS. 1-5, having a top side shown generally at 206, a bottom side shown generally at 208 defining a gliding surface 210, a tip or front end 212, a rear end 214, a longitudinal channel 216, laterally opposite side elements 218 and 220 and projections 222 and 224 at the front end 212 of the gliding device 202. Gliding device 202 further includes additional projections 226 and 228 at the rear end 214 of the gliding device 202 which are substantially similar to projections 222 and 224. In the channel 216, the gliding device 202 defines through-openings 236, 238, and 240, 242, and 244 to receive respective fasteners as described below.

Force transfer body 204 comprises a connecting element 230 and force transfer elements 232 and 234, each of which being substantially similar to force transfer element 134 described in reference to FIG. 1, and each being integrally connected to longitudinally opposite ends of the connecting element 230, such that force transfer elements 232 and 234 can slide in opposite longitudinal directions away from one another relative to the gliding device 202 while being held against the laterally opposite side elements 218 and 220.

The connecting element 230 is also substantially similar to connecting element 136 as described in reference to FIG. 1, such that each distal portion of the connecting element 230 can glide relative to the gliding device 202 while being held in place in the channel 216. However, in the present embodiment, the connecting element 230 also defines a central through-opening shown generally at 246 and sized to receive a fastener 248 such that the fastener 248 holds a central portion of the connecting element 230 in a generally constant longitudinally-centered position relative to the gliding device 202 when the fastener 248 is received in the through-opening 240.

Therefore, in the present embodiment, one or both of the front end 212 and the rear end 214 of the gliding device 202 may be deflected longitudinally in a direction substantially similar to direction 164 as shown in FIG. 4, and in response to such longitudinal deflection, gliding device 202 and connecting element 230 may curve in substantially the same manner as described in reference to FIG. 4. The longitudinal deflection of one or both ends of the gliding device 202 causes one or both of the force transfer elements 232 and 234 to move longitudinally relative to the gliding device 202 in directions opposite from one another toward front end 212 and rear end 214 respectively. When the force transfer element 232 moves toward front end 212, forces are imparted to projections 222 and 224 so as to cause lateral concavity in at least a portion of gliding surface 210 in a manner substantially similar as the manner described in reference to FIG. 4. Similarly, when the force transfer element 234 moves toward rear end 214, forces are imparted to projections 226 and 228 so as cause a lateral concavity in at least a portion of gliding surface 210 in a manner substantially similar as the manner described in reference to FIG. 4.

Figure 8:
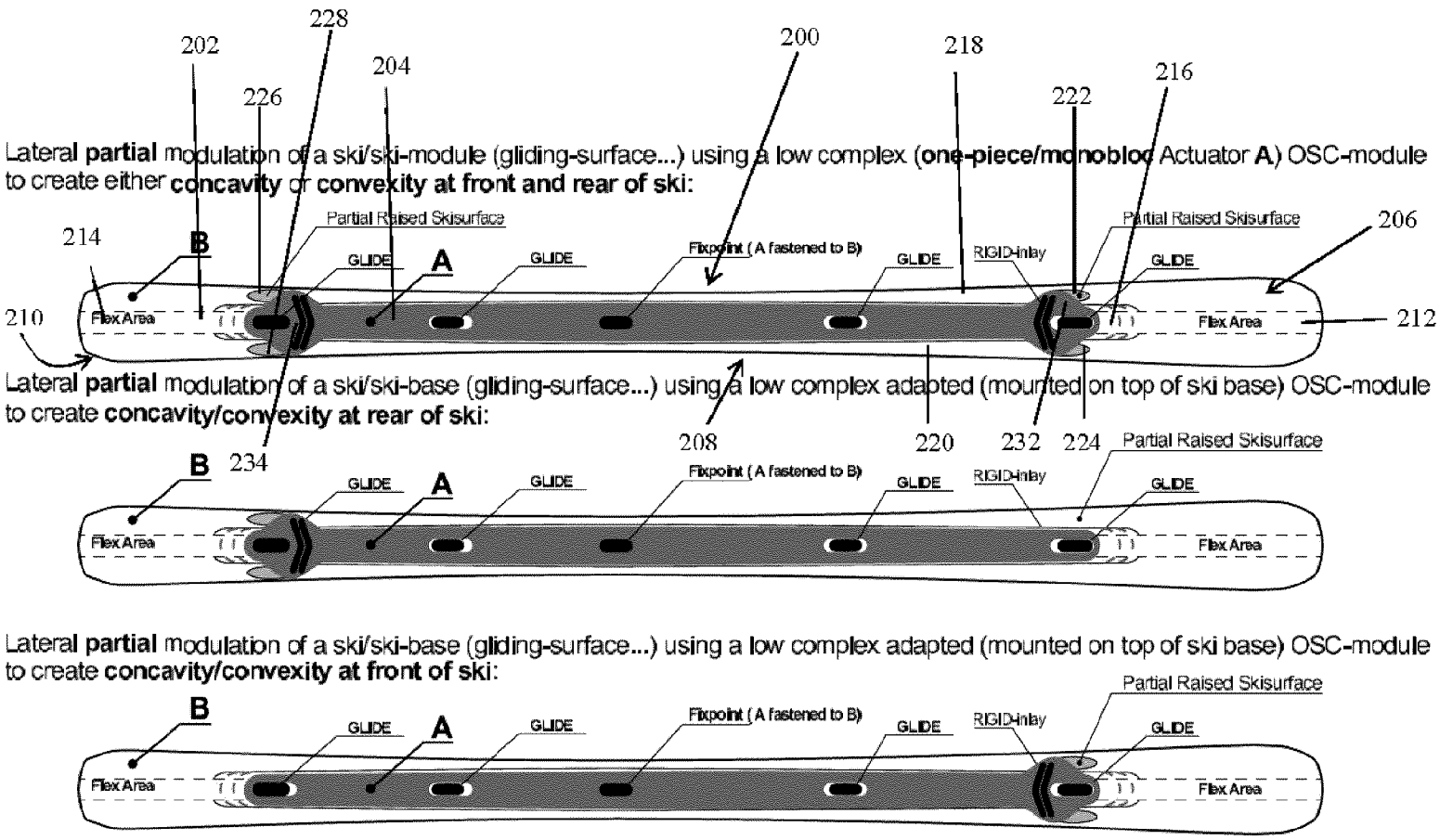
FIG. 8 illustrates gliding assemblies according to embodiments including the embodiment of FIG. 7.

As shown in FIG. 8, alternative embodiments may comprise a force transfer element like those described above integrally connected to one or both ends of connecting element 230.

Figure 9:
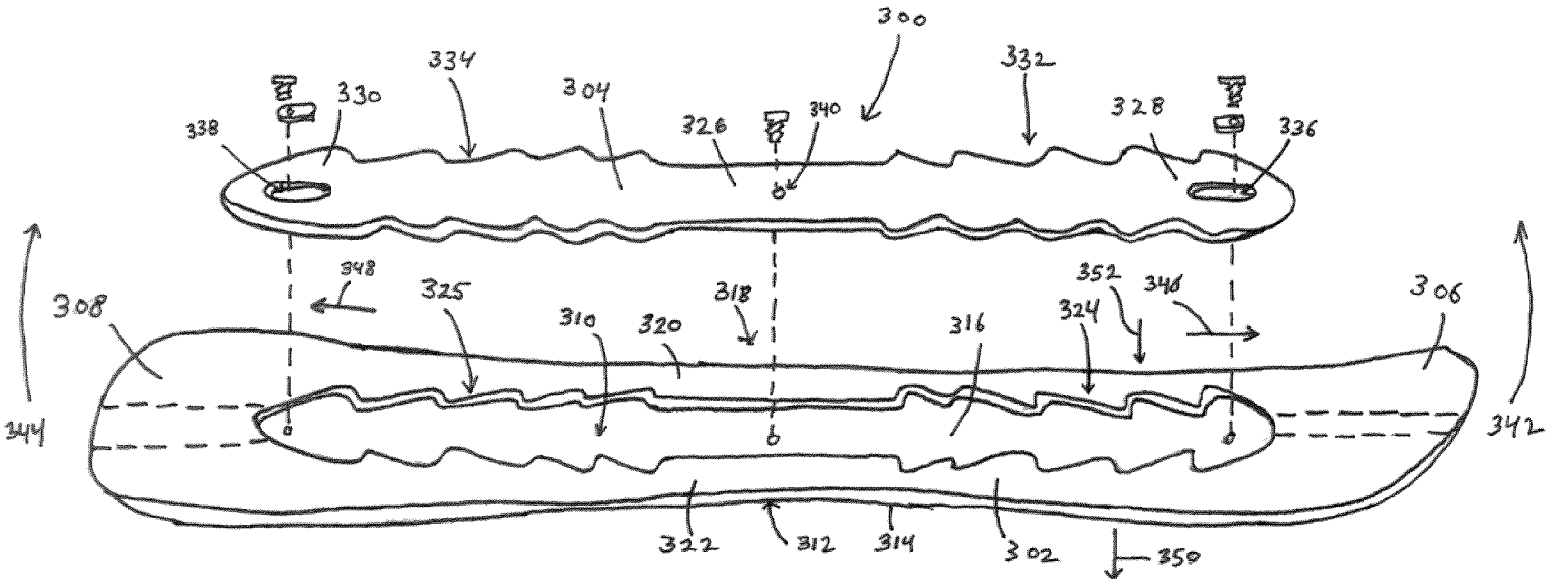
FIG. 9 illustrates a gliding assembly according to another embodiment.

Referring to FIG. 9, a gliding assembly according to another embodiment is shown generally at 300 and comprises a gliding device 302 and a force transfer body 304. In the present embodiment the gliding device 302 defines a front end 306, a rear end 308, a top side shown generally at 310 and a bottom side shown generally at 312 which defines a gliding surface 314. Gliding device 302 also defines a longitudinal channel 316 sized to receive the force transfer body 304 when assembled. Gliding device 302 also defines a binding region shown generally at 318 and laterally opposite side elements 320 and 322. In the present embodiment, laterally opposite edges of channel 316 define a plurality of surfaces shown generally at 324 and 325 tapering longitudinally away from the binding region 318 of channel 316 toward the front end 306 and the rear end 308 respectively.

In the present embodiment, force transfer body 304 defines a connecting element 326, being substantially the same longitudinal as binding region 318, and two force transfer elements 328 and 330 on opposite longitudinal ends of connecting element 326. Both force transfer elements 328 and 330 define a plurality of tapered surfaces shown generally at 332 and 334 respectively which align with and are sized to fit within the longitudinal profile created by the tapered surfaces of channel 316. Force transfer elements 328 and 330 define through-openings shown generally at 336 and 338 and being substantially similar as through-opening 138 described in reference to FIGS. 1-5 so that when a fastener is fastened in each through-opening 336 and 338, both force transfer elements 328 and 330 can slide in opposite longitudinal directions away from each other and relative to the gliding device 302 while being held within the channel 316. Connecting element 326 also defines a through-opening shown generally at 340 and being substantially similar to through-opening 156 as defined in reference to FIGS. 1-5 so that when a fastener is fastened through through-opening 340 a longitudinally central portion of the connecting element 326 is held in a generally constant position relative to the gliding device 302.

When gliding assembly 300 is assembled, force transfer body 304 is received in channel 316. One or both of the front end 306 and the rear end 308 of the gliding device 302 may be deflected longitudinally in a direction 342 and 344 respectively. Both longitudinal deflection in the direction 342 and 344 is in a direction opposite the gliding surface 314. In response to such longitudinal deflection, the gliding device 302 and the force transfer body 304 curve along different curvatures because the force transfer body 304 is on the top side 310 of the gliding device 302. Because the gliding device 302 and the force transfer body 304 curve along different curvatures, and because a fastener holds a central portion of the connecting element 326 in a generally constant position relative to the gliding device 302, longitudinal deflection of the gliding device 302 in the direction 342 causes the force transfer element 328 to move longitudinally relative to the gliding device 302 in a direction 346 toward the front end 306. When the force transfer element 328 moves in the direction 346, the plurality of tapered surfaces 332 impose generally lateral forces against the plurality of tapered surfaces 324. The same interaction occurs between the tapered surfaces 334 of force transfer element 330 and the tapered surfaces 325 of channel 316 upon deflection of the rear end 308 of the gliding device 302 in the direction 344.

The force transfer body 304 has sufficient rigidity to maintain the a generally planar shape, so as one or both of force transfer elements 328 and 330 move toward the forward and rear ends 306 and 308 respectively, the lateral forces imposed against tapered surfaces 324 and 325 are transferred to the laterally opposite side elements 320 and 322, which translate those forces into vertical forces in the directions 350 and 352 respectively toward the gliding surface 312, similar to the translation of forces as shown in FIG. 5. The laterally opposite side elements 320 and 322 have sufficient rigidity to transfer forces from the pluralities of tapered surfaces 324 and 325 longitudinally along at least a portion of the gliding device 302.

The number of tapered surfaces in each of the pluralities of tapered surfaces 324, 325, 332, and 334 may change in some embodiments, and a higher number of tapered surfaces may result in a more homogenous transfer of forces along at least a portion of the gliding device 302. In some embodiments, forces may be transferred along an entire length of the gliding device 302, or along a portion of the gliding device 302 such as a portion having approximately two thirds of the length of the gliding device 302. As indicated above, the laterally opposite side elements 320 and 322 include respective portions of the gliding surface 314, so that movement of the laterally opposite side elements 320 and 322 in the directions 350 and 352 respectively impart a concave shape to the gliding surface 314 substantially similar to the concave shape as shown in FIG. 5. The concave shape may be imparted along an entire length of the gliding device 302 or along a portion of the length of the gliding device 302, and the concave shape may be imparted at least along the binding region 318.

Figure 10:
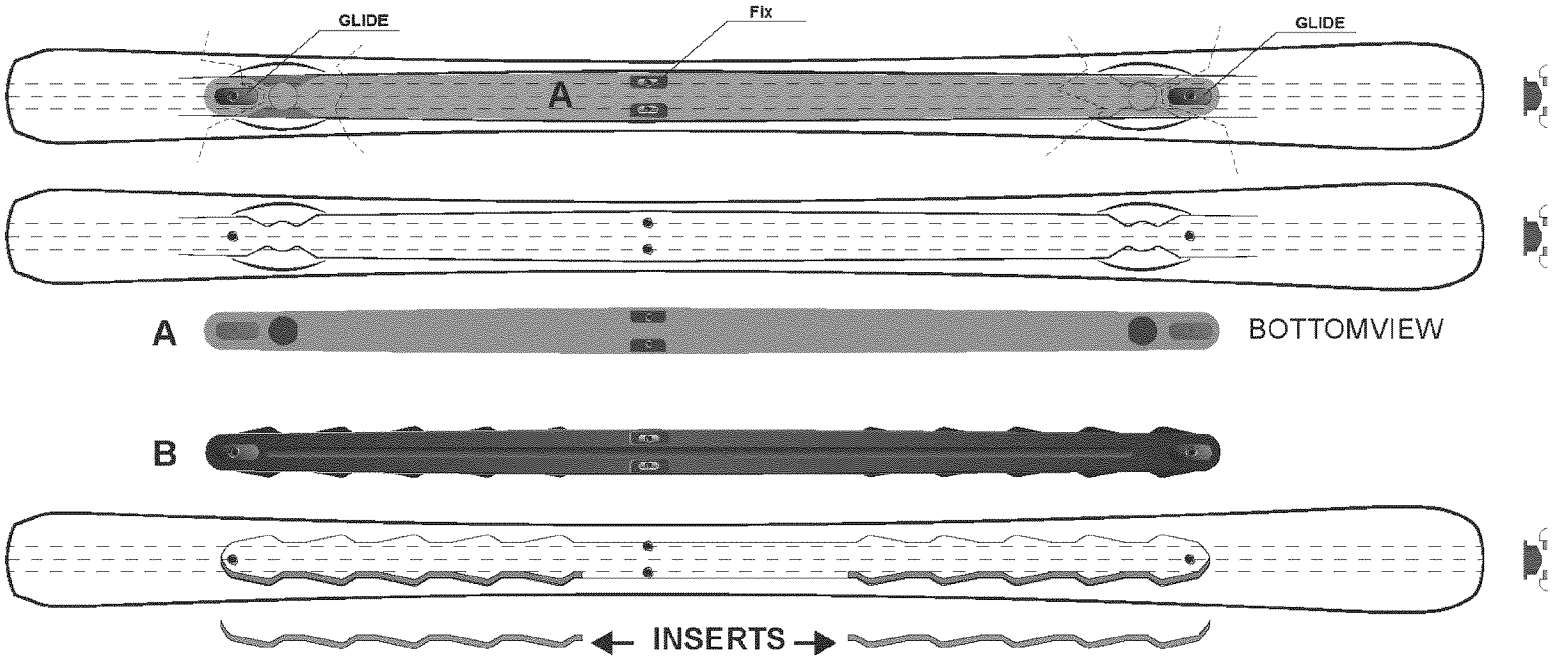
FIG. 10 illustrates gliding assemblies according to embodiments including the embodiment of FIG. 9.

FIG. 10 is an illustration of embodiments including the gliding assembly 300, and is also an illustration of an embodiment of partial modulation of a gliding surface using an integrated actuator (or OSC module) that may be embedded in U-shaped or V-shaped relief in a top sheet ski (that may include inserts as shown in FIG. 10), that may be flush to a top surface of the ski so that the top surface of the ski may be compatible with a standard (or Original Equipment Manufacturer ("OEM")) ski binding installation), and that may create concavity at a front, at a rear, at the front and the rear, or at multiple points of the ski (as shown at B in FIG. 10) for various desired characteristics.

Figure 11:
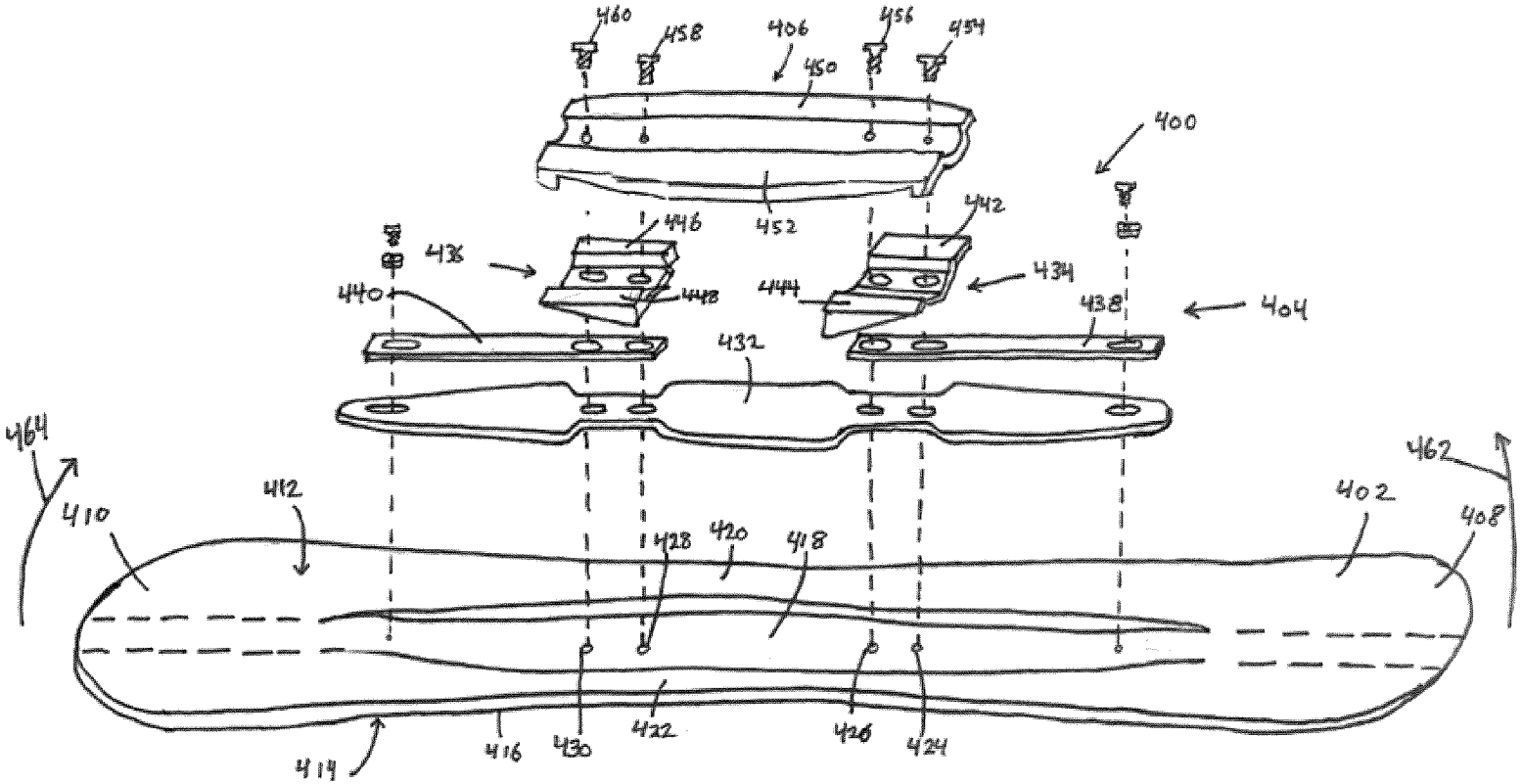
FIGS. 11 and 12 illustrate a gliding assembly according to another embodiment.
Figure 12:
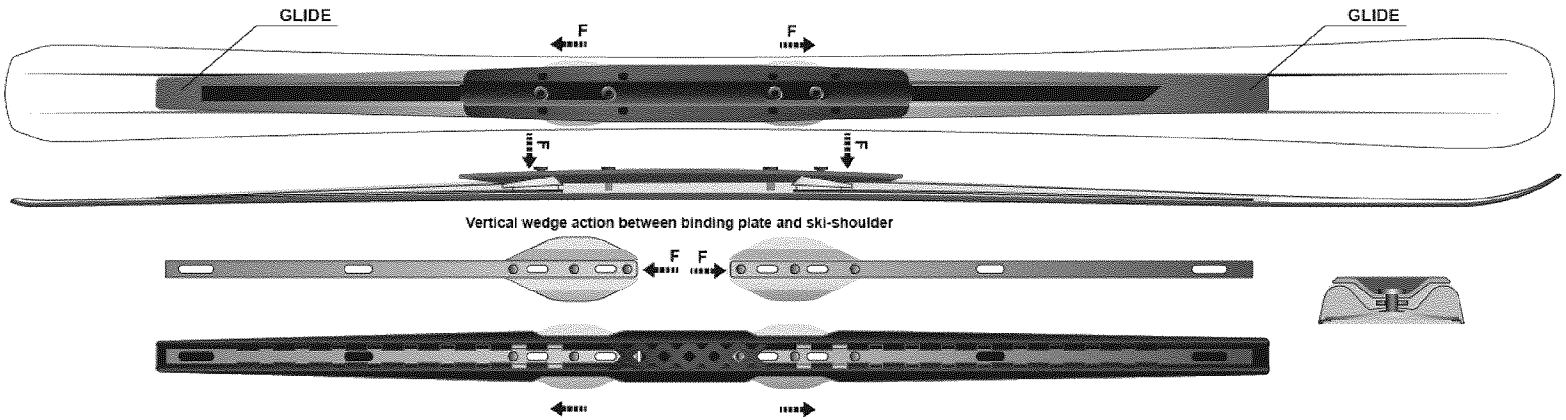

Referring to FIGS. 11 and 12, a gliding assembly according to another embodiment is shown generally at 400. Gliding assembly 400 comprises a gliding device 402, a force transfer assembly shown generally at 404, and a binding plate shown generally at 406.

Gliding device 402 is substantially similar to the gliding devices previously described, including a front end 408, a rear end 410, a top side 412, a bottom side 414 defining a gliding surface 416, a channel 418, and laterally opposite side elements 420 and 422. In the present embodiment, channel 418 is widest at its longitudinal center and narrow towards ends 408 and 410. In other embodiments, channel 418 may have a constant width along its entire length. Gliding device 402 also defines through-openings 424, 426, 428, and 430 sized to receive fasteners as described below.

Force transfer assembly 404 comprises a connecting element 432, force transfer elements shown generally at 434 and 436, and connecting elements 438 and 440. Force transfer elements 434 and 436 are coupled to central ends of the connecting elements 438 and 440 to move longitudinally with the central ends of the connecting elements 438 and 440, and define laterally opposite projections 442, 444, 446, and 448 which are vertically tapered toward the front end 408 and rear end 410 of the gliding device respectively. Further, distal ends of connecting elements 438 and 440 are coupled to distal ends of connecting element 432 to move longitudinally with the distal ends of the connecting element 432. When gliding assembly 400 is assembled, each of laterally opposite projections 442, 444, 446, and 448 is vertically adjacent against one of laterally opposite side elements 420 and 422 and vertically adjacent vertically tapered surfaces of the binding plate 406. The force transfer elements 434 and 436 each have sufficient rigidity to resist compression when transferring forces to the laterally opposite side elements 420 and 422 of the gliding device 402 as described below. Elongated through-openings are defined in each of the connecting element 432, force transfer elements 434 and 436, and connecting element 438 and 440 such that the forward and rearward ends of force transfer assembly 404 may slide longitudinally relative to gliding device 402 when fasteners are received through the aforementioned elongated through-openings.

Binding plate 406 defines two laterally opposite wings 450 and 452 on laterally opposite sides of generally longitudinal axis. When force transfer assembly 404 is assembled, bottom vertically tapered surfaces of both of the wings 450 and 452 are adjacent to top surfaces of the laterally opposite projections 442, 444, 446 and 448. Binding plate 406 also defines four through-openings sized to receive four fasteners 454, 456, 458, and 460 which secure the force transfer assembly to gliding device 402 upon being received in through-openings 424, 426, 428, and 430. Binding plate 406 has sufficient rigidity to maintain the bottom vertically tapered surfaces of both of the wings 450 and 452 in generally constant positions relative to a portion of gliding device 402 between laterally opposite side elements 420 and 422.

In operation, when force transfer assembly 404 is assembled and attached to gliding device 402 along with binding plate 406 using fasteners 454, 456, 458, and 460, one or both of the front end 408 and rear end 410 of the gliding device 402 may be deflected longitudinally in a direction 462 and 464 respectively. Both longitudinal deflection directions 462 and 464 are opposite the gliding surface 416. In response to such longitudinal deflection, the gliding device 402 and the connecting element 432 curve along different curvatures as described in reference to previous embodiments. Because the fasteners 454, 456, 458, and 460 hold the binding plate 406 in a generally constant position relative to the gliding device 402, and because of the elongated through-openings defined in each of the force transfer elements 434 and 436, connecting element 438 and 440, and connecting element 432 of the force transfer assembly 404, longitudinal deflection of one or both ends of the gliding device 402 in the direction 462 and 464 respectively causes opposite ends of the force transfer assembly 404 to move longitudinally relative to the gliding device 402 in opposite directions away from each other; that is, force transfer element 434 will move toward front end 408, and force transfer element 436 will move toward rear end 410. When the laterally opposite projections 442 and 444 of force transfer element 434 move toward the front end 408, their vertically-tapered shape imports a force upwards against binding plate 406 and downwards against laterally opposite side elements 420 and 422. Both the force transfer element 434 and binding plate 406 have sufficient rigidity to maintain generally planar shapes, so as the force transfer element 434 moves in the direction toward the front end 408, the force imparted by lateral projections 442 and 444 causes the laterally opposite side elements 420 and 422 downward in a direction toward the gliding surface 416. As with previous embodiments, the laterally opposite side elements 420 and 422 have sufficient rigidity to transfer forces imparted by the laterally opposite projections 442 and 444 longitudinally along at least a portion of the gliding device 402, and in some embodiments, along an entire length of the gliding device 402. The laterally opposite side elements 420 and 422 include respective portions of the gliding surface 416, so that movement of the laterally opposite side elements 420 and 422 in a directions towards gliding surface 416 imparts a concave shape to the gliding surface 416. The concave shape may be imparted along an entire length of the gliding device 402 or along a portion of the length of the gliding device 402, and the concave shape may be imparted at least along the portion of the gliding device 402 beneath binding plate 406.

FIG. 12 is an illustration of the gliding assembly 400, and is also an illustration of an embodiment of lateral modulation of a gliding surface of a gliding device (such as a ski, for example) using vertical wedge action between a binding plate and a top of a shoulder of the ski. In the embodiment of FIG. 12, force transfer elements (or actuator wedge elements, which may include polytetrafluoroethylene (or Teflon™) or a self-lubricating thermoplastic, for example) are attached to force transducers (profiled metal bands in the embodiment shown) and may act against the top of the ski shoulder to induce lateral concavity.

Figure 13:
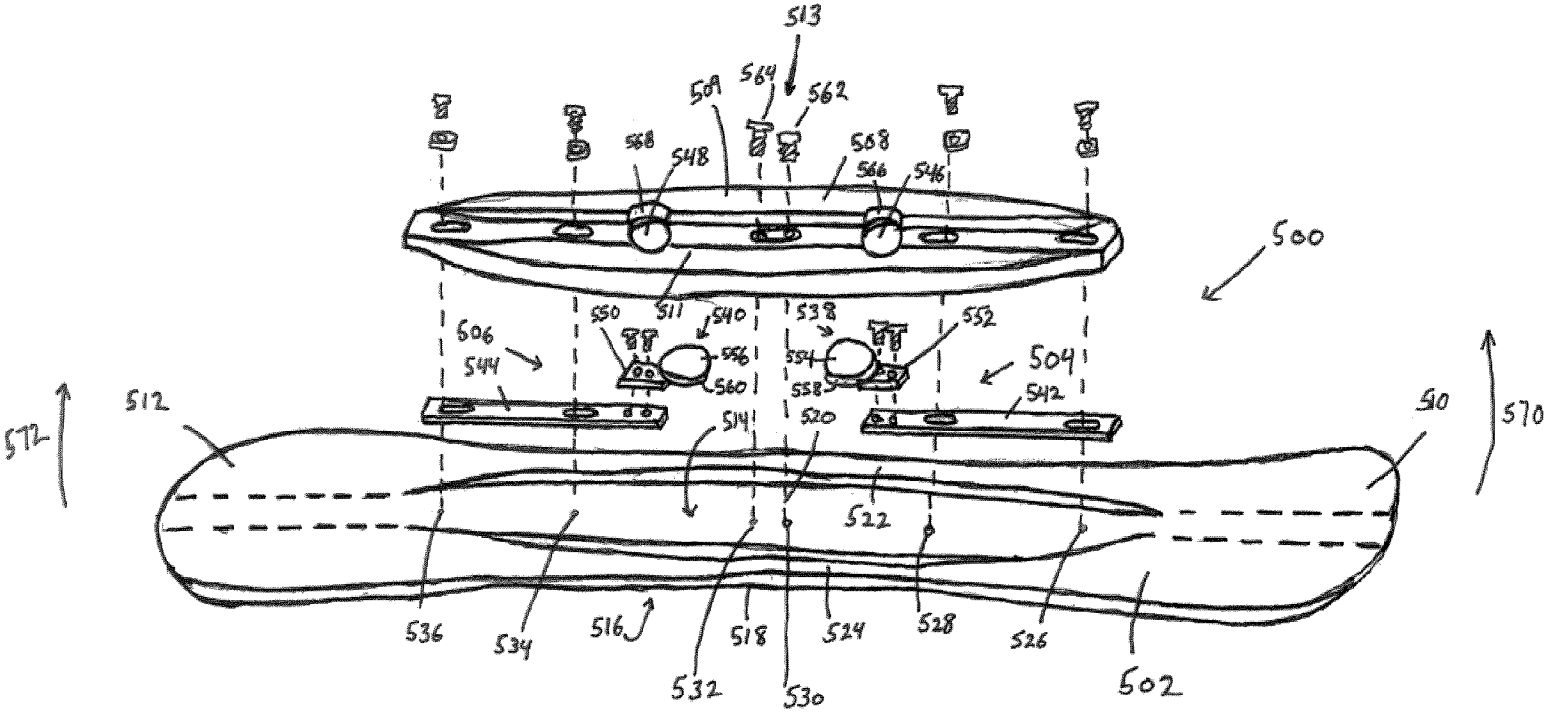
FIGS. 13 and 14 illustrate a gliding assembly according to another embodiment.
Figure 14:
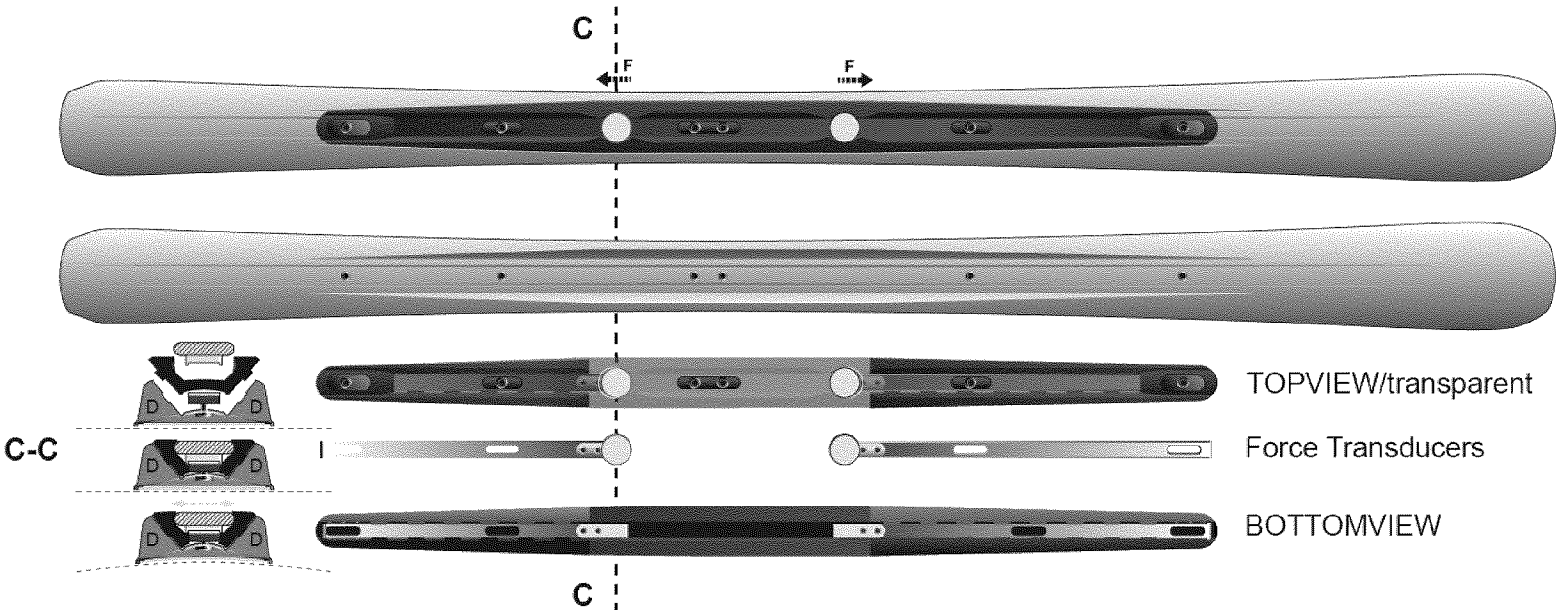

Referring to FIGS. 13 and 14, a gliding assembly according to another embodiment is shown generally at 500. Gliding assembly 500 comprises a gliding device 502, force transfer element assemblies shown generally at 504 and 506, and a connecting element 508.

Gliding device 502 is substantially similar to the gliding devices previously described, including a front end 510, a rear end 512, a top side shown generally at 514, a bottom side shown generally at 516 defining a gliding surface 518, a channel 520, and laterally opposite side elements 522 and 524. In the present embodiment, channel 520 is widest at its longitudinal center and narrow towards ends 510 and 512. In other embodiments, channel 520 may have a constant width along its entire length. Gliding device 502 also defines through-openings 526, 528, 530, 532, 534, and 536 sized to receive fasteners as described below.

Force transfer element assemblies 504 and 506 comprise a force transfer element 538 and 540 and connecting elements 542 and 544 which are attachable to each respective force transfer element so as to encourage each force transfer element assembly 504 and 506 to slide longitudinally relative to the gliding device 502 as described below. Connecting elements 542 and 544 each define two elongated through-holes substantially similar to those as described in reference to FIGS. 11-12. Force transfer elements 538 and 540 each comprise a rectangular connector (550, 552) operable to attach to metal rods 542 and 544. Rectangular connectors 550 and 552 are integrally attached to circular elements 554 and 556 sized to be received in circular through-holes 546 and 548 in the connecting element 508 as described below. Circular elements 554 and 556 define circumferential retaining surfaces 558 and 560 respectively.

Connecting element 508 is sized to be received within channel 520 and defines four elongated through-openings each being sized to receive a gliding element and a fastener in substantially the same manner as described in reference to through-opening 138, gliding element 140, and fastener 142, such that force transfer element assemblies 504 and 506 are operable to move longitudinally relative to the gliding device 502 upon deflection of either the front end 510 or rear end 512 of the gliding device 502 as described below. The connecting element 508 includes a binding region shown generally at 513 where a ski boot or other foot gear or binding therefore may be bound to the connecting element 508. Connecting element 508 also defines lateral projections 509 and 511. Connecting element 508 also defines two additional through-openings under the binding region to receive two additional fasteners 562 and 564 such that fasteners 562 and 564 hold a central portion of the connecting element 508 in a generally constant longitudinally-centered position relative to the gliding device 502 when the fasteners 562 and 564 are received in through-openings 530 and 532. Connecting element 508 also defines circular through-openings 546 and 548 sized to receive circular elements 554 and 556 when gliding assembly 500 is assembled. Circular through-openings 546 and 548 define respective retaining surfaces 566 and 568.

When assembled, circular elements 554 and 556 are received in circular through-openings 546 and 548 such that circumferential retaining surfaces 558 and 560 are received against surfaces 566 and 568 respectively. Lateral projections 509 and 511 are receiving against laterally opposite side elements 522 and 524. One or both of the front end 510 and rear end 512 of the gliding device 502 may be deflected longitudinally in a direction 570 and 572 respectively. Both longitudinal deflection directions 570 and 572 are opposite the gliding surface 518. In response to such longitudinal deflection, the gliding device 502 and the connecting element 508 curve along different curvatures as described in reference to previous embodiments. Because the fasteners 562 and 564 hold the connecting element 508 in a generally constant position relative to the gliding device 502, and because of the elongated through-openings defined in each of the connecting elements 542 and 544 and in connecting element 508, longitudinal deflection of one or both ends of the gliding device 502 in the direction 570 and 572 respectively causes force transfer element assemblies 504 and 506 to move longitudinally relative to the gliding device 502 in opposite directions away from each other; that is, force transfer element assembly 504 will move toward front end 510, and force transfer element assembly 506 will move toward rear end 512. Consequently, the circumferential retaining surfaces 558 and 560 will impart lateral forces against surfaces 566 and 568 of the connecting element 508. As the force transfer element assemblies 504 and 506 move in opposite longitudinal directions, the forces imparted against surfaces 566 and 568 cause the laterally opposite projections 509 and 511 to impart substantially downward forces against laterally opposite side elements 522 and 524 in a direction toward the gliding surface 518. As with previous embodiments, the laterally opposite side elements 522 and 524 have sufficient rigidity to transfer forces imparted by the laterally opposite projections 509 and 511 longitudinally along at least a portion of the gliding device 502, and in some embodiments, along an entire length of the gliding device 502. The laterally opposite side elements 522 and 524 include respective portions of the gliding surface 518, so that movement of the laterally opposite side elements 522 and 524 in a directions towards gliding surface 518 imparts a concave shape to the gliding surface 518 along an entire length of the gliding device 502 or along at least a portion of the length of the gliding device 502, and the concave shape may be imparted at least along the binding region of the gliding assembly 500.

FIG. 14 is an illustration of the gliding assembly 500, and is also an illustration of an embodiment of lateral homogenous transitional modulation of a gliding surface of a gliding device (such as a ski, for example) using an inserted and/or integrated self-contained OSC-module binding platform that may be fused with the ski during production and/or mounted on top of the ski. The binding platform of the embodiment of FIG. 14 may include integrated inverse-operating force transfer elements (or force transducers or actuator spreading elements) attached to profiled metal bands. Again, the force transfer elements in the embodiment shown may include polytetrafluoroethylene (or Teflon™) or a self-lubricating thermoplastic, for example, and may act against their own housing and/or frame and their own relief profiles, and not against a top sheet of the ski, which may generate homogenous transitional rotational movement of outer side portions D of the ski to cause concavity, for example over an entire length of the ski. Such a self-contained module may generate concavity within an OSC module itself and transfer forces (as described herein, for example) onto any ski or other gliding device.

Figure 15:
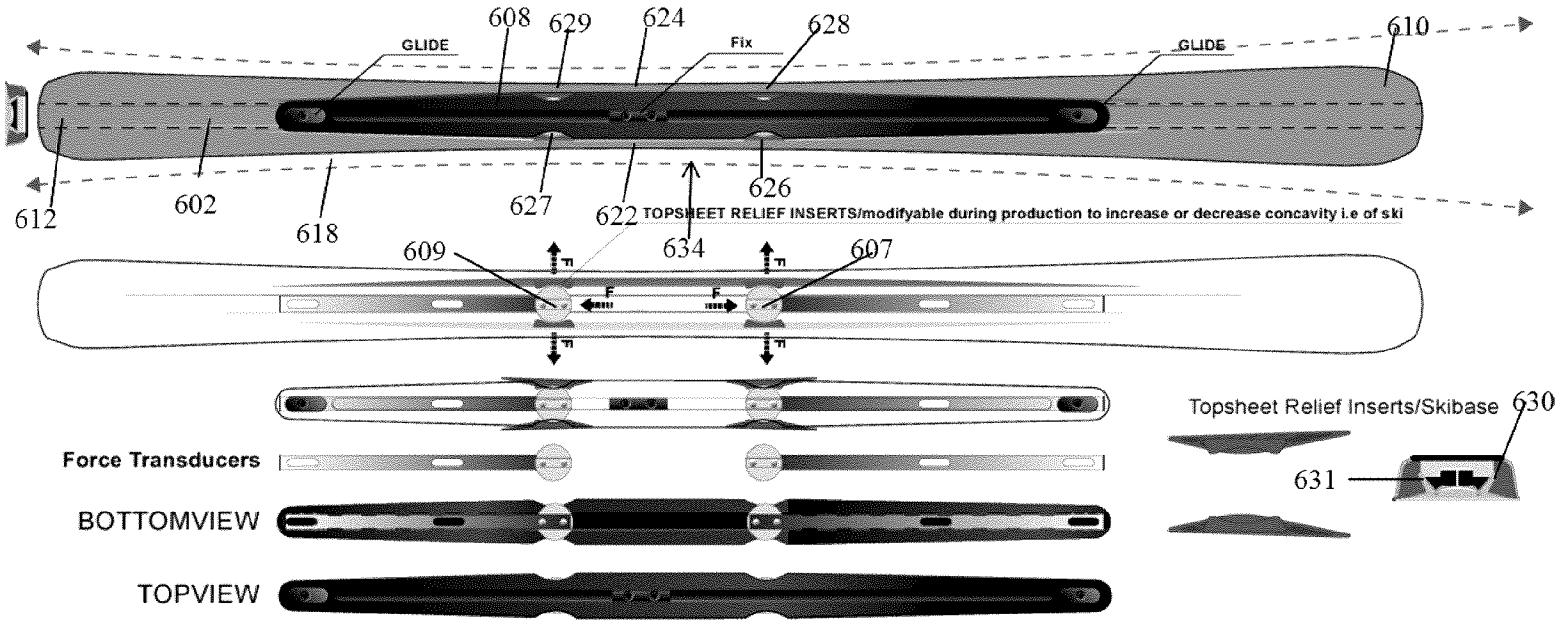
FIG. 15 illustrates a gliding assembly according to another embodiment.

Referring to FIG. 15, a gliding assembly according an alternative embodiment is shown generally at 600 being substantially similar to the embodiment described in reference to FIGS. 13 and 14. Gliding assembly 600 defines a gliding device 602, a connecting element 604, and force transfer element assemblies 606 and 608 comprising connecting elements and force transfer elements 607 and 609, and which are substantially identical to force transfer element assemblies 504 and 506 described in reference to the previous embodiment.

Gliding device 502 defines a front end 610, a rear end 612, a top side shown generally at 614, a bottom side shown generally at 616 defining a gliding surface 618, a channel 620, and laterally opposite side elements 622 and 624. Gliding device 502 also defines projections 626, 627, 628, and 629 defining circumferential surfaces 630, 631, 632, and 633.

An elongated through-opening is defined at each distal end of connecting element 604, each being sized to receive a gliding element and a fastener in substantially the same manner as described in reference to the previous embodiment such that force transfer element assemblies 606 and 608 are operable to move longitudinally relative to the gliding device 602 upon deflection of either the front end 610 or rear end 612 of the gliding device 602 as described below. Connecting element 604 also includes a binding region shown generally at 634 where a ski boot or other foot gear or binding therefore may be bound to the connecting element 604. Connecting element 604 also defines two additional through-openings under the binding region in substantially the same manner as described in reference to the previous embodiment such that the connecting element 604 is centrally held relative to the gliding device 602.

When assembled, force transfer elements 607 and 609 are retained against circumferential surfaces 630, 631, 632, and 633 underneath connecting element 604. One or both of the front end 610 and rear end 612 of the gliding device 602 may be deflected longitudinally in a direction opposite the gliding surface 618. In response to such longitudinal deflection, the gliding device 602 and the connecting element 608 curve along different curvatures as described in reference to previous embodiments. Such longitudinal deflection of one or both ends of the gliding device 602 respectively causes force transfer elements 607 and 609 to move longitudinally relative to the gliding device 602 in opposite directions away from each other for the same reasons as described in reference to the previous embodiment; that is, force transfer element 607 will move toward front end 610, and force transfer element 609 will move toward rear end 612. Consequently, the force transfer elements 607 and 609 will impart lateral forces against circumferential surfaces 630, 631, 632, and 633 of projections 626, 627, 628, and 629. The connecting element 608 has sufficient rigidity to maintain a generally planar shape, so as the force transfer elements 607 and 609 move in opposite longitudinal directions, the forces imparted against circumferential surfaces 630, 631, 632, and 633 cause the laterally opposite side elements 622 and 624 to move in a direction toward the gliding surface 618 for the same reasons as described in reference to the previous embodiment. The laterally opposite side elements 622 and 624 have sufficient rigidity to transfer said forces longitudinally along at least a portion of the gliding device 602, and in some embodiments, along an entire length of the gliding device 602. The laterally opposite side elements 622 and 624 include respective portions of the gliding surface 618, so that movement of the laterally opposite side elements 622 and 624 in a directions towards gliding surface 618 imparts a concave shape to the gliding surface 618 along an entire length of the gliding device 602 or along at least a portion of the length of the gliding device 602, and the concave shape may be imparted at least along the binding region of the gliding assembly 634.

FIG. 15 is also an illustration of an embodiment of lateral modulation of a gliding surface of a gliding device (such as a ski, for example) using an OSC-module binding platform that may be inserted in and/or integrated with the ski and that may be flush with a top surface of the ski. The binding platform of FIG. 15 may include integrated inverse-operating force transfer elements (or force transducers or actuator spreading elements) attached to profiled metal bands. Again, the force transfer elements in the embodiment shown may include polytetrafluoroethylene (or Teflon™) or a self-lubricating thermoplastic, for example, and may act against a shoulder relief at a center of the ski or in a top sheet at the center area of ski, which may generate homogenous transitional rotational concavity, which may travel over an entire length of the ski due to materials in the ski shoulder. As indicated in FIG. 15, top sheet relief inserts may be modifiable (during production, for example) to increase or decrease concavity that may be imparted to the ski.

Figure 16:
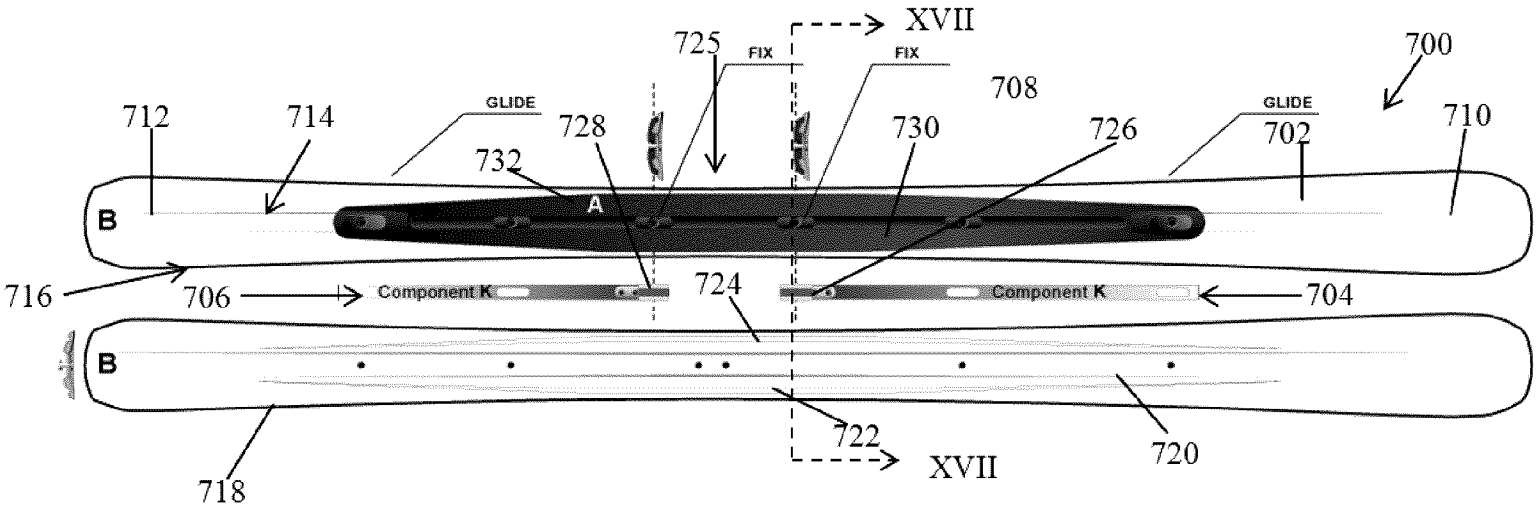
FIGS. 16 and 17 illustrate a gliding assembly according to another embodiment.
Figure 16:
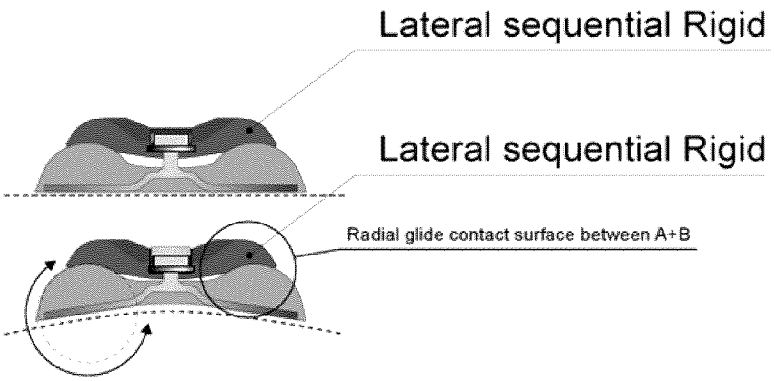
Figure 17:
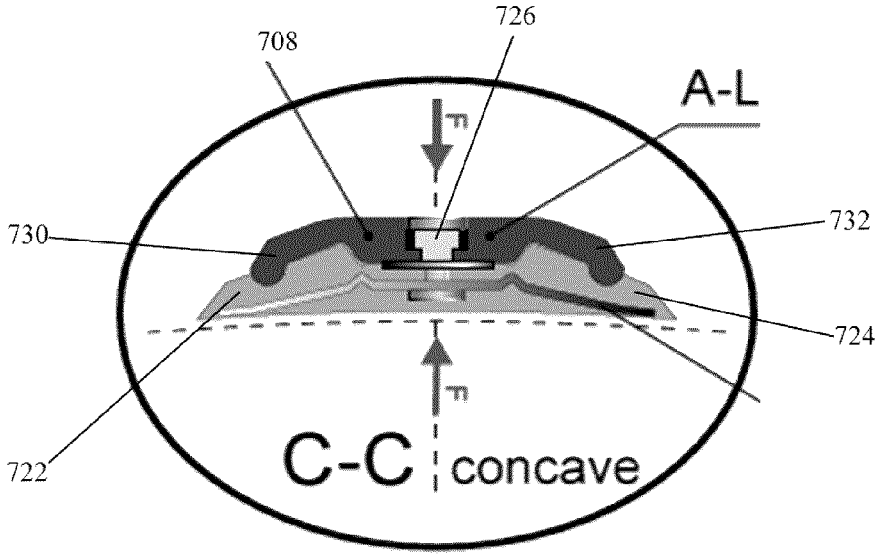

Referring to FIGS. 16 and 17, a gliding assembly is shown generally at 700 according to another embodiment. Gliding assembly 700 includes a gliding device 702, force transfer element assemblies 704 and 706, and connecting element 708, all being substantially similar to the one described in reference to the previous embodiment. Gliding device 702 comprises a front end 710, a rear end 712, a top side 714, a bottom side 716 defining a gliding surface 718, a channel 720, laterally opposite side elements 722 and 724 and a longitudinally central binding region shown generally at 725.

Force transfer element assemblies 704 and 706 comprise force transfer elements 726 and 728 which do not define lateral projections such as those described in the previous embodiment. Instead, force transfer elements 726 and 728 are tapered longitudinally while maintaining a constant lateral width such that they are vertically thinnest toward binding region 725 of the gliding device 702 and vertically thickest toward distal ends 710 and 712 respectively of gliding device 702.

When either of the distal ends 710 and 712 of the gliding device 702 is longitudinally deflected in a direction opposite the gliding surface 718, force transfer element assemblies 704 and 706 move longitudinally relative to the gliding device 702 in substantially the same way as described in reference to the previous embodiment. As force transfer elements 726 and 728 move toward distal ends 710 and 712 of gliding device 702 respectively, they exert an upward force against connecting element 708.

Referring to FIG. 17, a lateral profile of gliding assembly 700 is shown when assembled. Because connecting element 708 is rigid enough to maintain a generally planar shape, the force exerted by force transfer elements 726 and 728 is translated into a downward force exerted against laterally opposite side elements 722 and 724 by lateral projections 730 and 732 defined on connecting element 708. In the present embodiment, edges of lateral projections 730 and 732 are sized to be received in corresponding channels in laterally opposite side elements 722 and 724 respectively, which may seal portions of the gliding assembly 700 against intrusion by moisture when in use and may also promote more even distribution of force against laterally opposite side elements 722 and 724.

The laterally opposite side elements 722 and 724 have sufficient rigidity to transfer said forces longitudinally along at least a portion of the gliding device 702, and in some embodiments, along an entire length of the gliding device 702. The laterally opposite side elements 722 and 724 include respective portions of the gliding surface 718, so that movement of the laterally opposite side elements 722 and 724 in a direction towards gliding surface 718 imparts a concave shape to the gliding surface 718 along an entire length of the gliding device 702 or along at least a portion of the length of the gliding device 702, and the concave shape may be imparted at least along the binding region 725.

FIGS. 16 and 17 are also an illustration of an embodiment of generation of lateral homogenous transitional modulation from a center of a ski using an OSC module. The embodiment of FIGS. 16 and 17 may include integrated inverse-operating force transfer elements (or force transducers or actuator wedge elements) attached to profiled metal bands, and the force transfer elements in the embodiment shown may include polytetrafluoroethylene (or Teflon™) or a self-lubricating thermoplastic, for example. Alternatively, the embodiment of FIGS. 16 and 17 may involve generating a pulling effect between A and B (as shown at "C-C Concave-convex" in FIG. 6, for example) using standoffs of a titanal inlay in the ski B and wedged gliders of the component K, which may generate homogenous transitional concavity over the whole longitudinal length of the ski.

Figure 18:
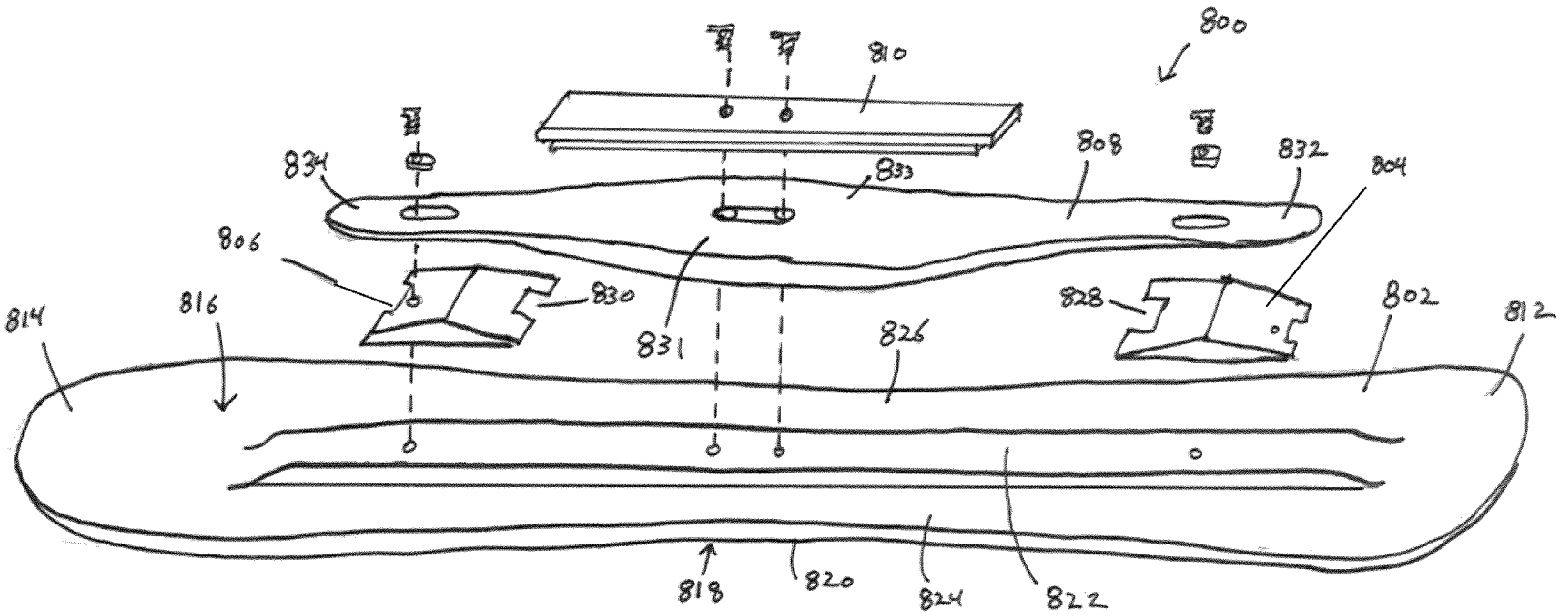
FIGS. 18 and 19 illustrate a gliding assembly according to another embodiment.
Figure 19:
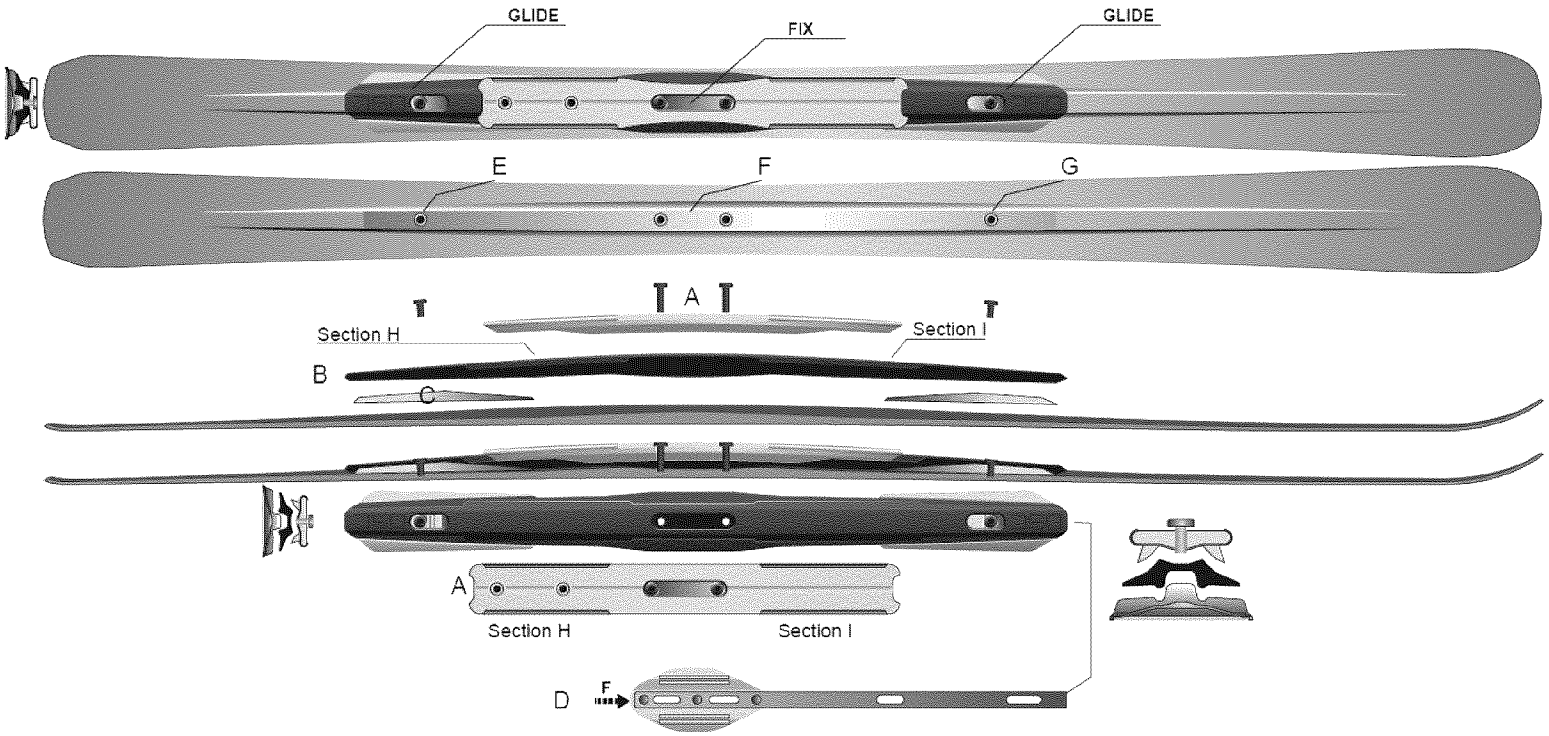

Referring to FIGS. 18 and 19, a gliding assembly according to another embodiment is shown generally at 800 being substantially similar to the embodiment described in reference to FIGS. 11 and 12 and having a gliding device 802, force transfer elements 804 and 806, a connecting element 808, and a binding plate 810.

Gliding device 802 defines a front end 812, a rear end 814, a top side shown generally at 816, a bottom side shown generally at 818 defining a gliding surface 820, a longitudinal protrusion 822, and laterally opposite side elements 824 and 826. Force transfer elements 804 and 806 are longitudinally tapered such that they are vertically thickest at their longitudinal centers. Force transfer elements 804 and 806 also define bottom longitudinal channels 828 and 830 respectively which are sized to receive longitudinal protrusion 822 when gliding assembly 800 is assembled such that laterally opposite sides of force transfer elements 804 and 806 are received against laterally opposite side elements 824 and 826 of gliding device 802. Force transfer elements 804 and 806 are fixed in a relatively stationary position relative to gliding device 802 when gliding assembly 800 is assembled.

Connecting element 808 defines lateral projections 831 and 833 which, when assembled, are received against laterally opposite side elements 824 and 826. Connecting element 808 also defines a front end 832 and a rear end 834 which each define elongated through-openings operable to receive gliding elements and fasteners in a substantially similar manner as described in reference to previous embodiments such that, upon deflection of one or both distal ends 812 and 814 of gliding device 802 in a direction opposite the gliding surface 820, one or both of distal ends 832 and 834 are operable to move longitudinally toward front end 812 and rear end 814 respectively relative to gliding device 802. Connecting element 808 also defines two longitudinally-central through-holes sized to receive fasteners in the same manner as described in reference to previous embodiments such that a longitudinally-central portion of connecting element 808 located beneath binding plate 810 is fixed in a stationary position relative to gliding device 802.

Binding plate 810 is where a ski boot or other foot gear may be bound. Binding plate 810 defines longitudinally-central through-openings operable to receive fasteners which can fasten binding plate 810 to connecting element 808 and to gliding 802 in substantially the same was as described in reference to FIGS. 11 and 12 such that binding plate 810 remains at all times substantially stationary relative to gliding device 802.

When one or both of front end 812 or rear end 814 of gliding device 802 is longitudinally deflected in a direction opposite gliding surface 820, one or both distal ends 832 and 834 of connecting element 808 move longitudinally toward front end 812 and rear end 814 respectively for the same reasons as described in reference to previous embodiments. In doing so, connecting element 808 moves longitudinally against force transfer elements 804 and 806. The connecting element 808 has sufficient rigidity to maintain a generally planar shape, so as one or both of its distal ends move across force transfer elements 804 and 806, forces in the direction of gliding surface 820 are imparted by force transfer elements 804 and 806, as well as by lateral projections 831 and 833, against laterally opposite side elements 822 and 824 to cause the laterally opposite side elements 822 and 824 to move in a direction toward the gliding surface 820, for the same reasons as described in reference to previous embodiments. The laterally opposite side elements 822 and 824 and connecting element 808 each have sufficient rigidity to transfer said forces longitudinally along at least a portion of the gliding device 802, and in some embodiments, along an entire length of the gliding device 802. Movement of the laterally opposite side elements 822 and 824 in a direction towards gliding surface 820 imparts a concave shape to the gliding surface 820 along an entire length of the gliding device 802 or along at least a portion of the length of the gliding device 802 for the same reasons as described in reference to previous embodiments, and the concave shape may be imparted at least along a region of the gliding assembly 800 under binding plate 810.

FIGS. 18 and 19 are also an illustration of an embodiment of compact induction of lateral homogenous transitional concavity into a gliding surface of a gliding device (such as a ski, for example) by integrating OSC working principles into a binding platform itself. The embodiment of FIGS. 18 and 19 may induce dynamic concavity on the gliding surface on flex of the ski utilizing elements that may attach a binding on a ski. In embodiment of FIGS. 18 and 19, fasteners (such as threaded plugs, for example) may fasten an inverted U-shaped carrier element B on a T-shaped ski base with low-profile shoulders (which may allow lateral flex) at mounting points E, F, and G such that the carrier element B can slide relative to the T-shaped ski base at mounting points E and G and such that the carrier element B is locked or fixed relative to the T-shaped ski base at point F. The carrier element B also provides free-gliding reliefs or tongues for a binding base A in sections H and I on the carrier element B. The free-gliding action of the carrier element B at mounting points E and G, in interaction with internal wedged elements C that may be fixed in position on the ski by tongue-and-groove relief, for example, may induce a force on shoulders of the ski at mounting points E and G in relation to a longitudinal center of the ski, which may create concavity. In combination with D (which may be similar to a like element in the embodiment of FIG. 12), additional pressure on the shoulders of the ski can also be induced at the center of the ski.

Figure 20:
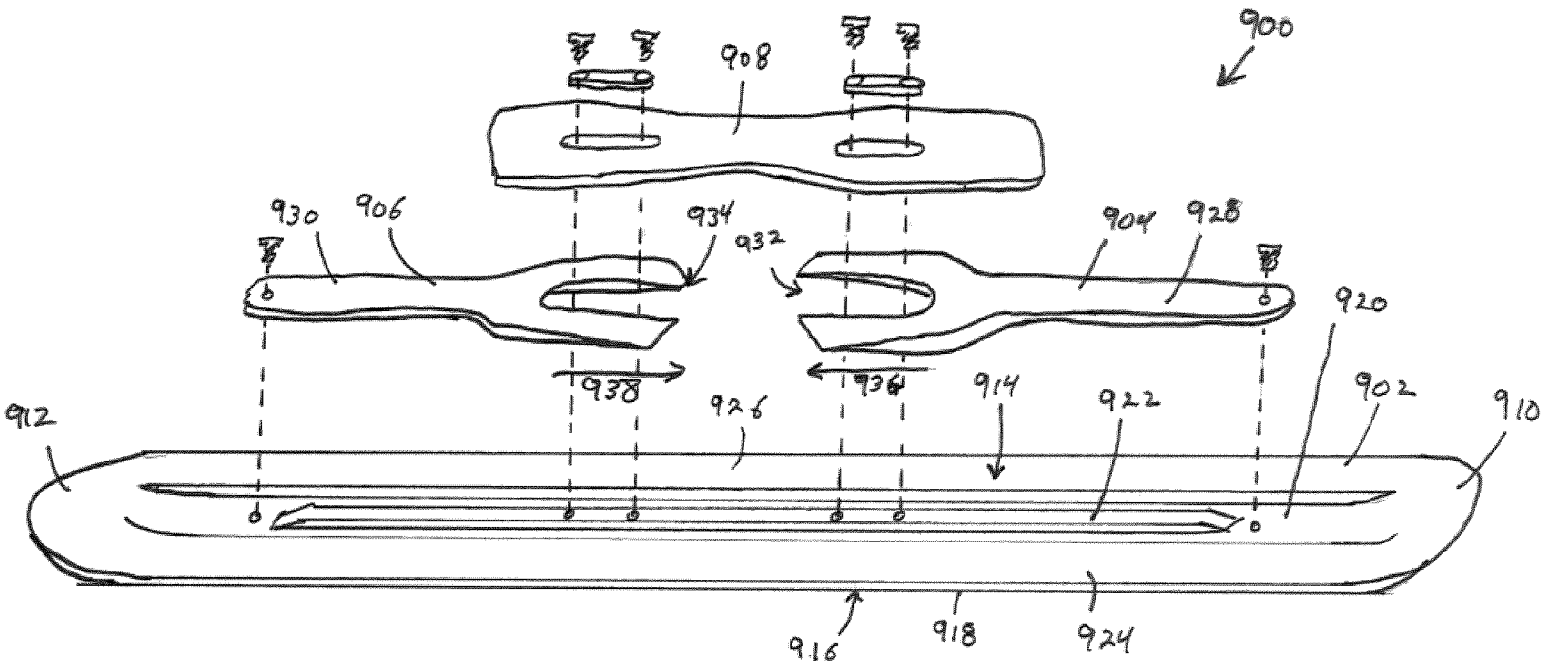
FIG. 20 illustrates a gliding assembly according to another embodiment.

Referring to FIG. 20, a gliding assembly according to another embodiment is shown generally at 900 which operates on substantially the same working principles as described in reference to previous embodiments. Gliding assembly 900 defines a gliding device 902, force transfer bodies 904 and 906, and a binding plate 908. Gliding device 902 includes a front end 910, a rear end 912, a top side shown generally at 914, a bottom side 916 defining a gliding surface 918, a longitudinal channel 920 defining a longitudinal projection 922, and laterally opposite side elements 924 and 926. Force transfer bodies 904 and 906 each define a connecting element 928 and 930 respectively and force transfer elements shown generally at 932 and 934 respectively extending longitudinally from connecting elements 928 and 930 respectively in longitudinal directions opposite the front end 910 and rear end 912 respectively. Force transfer elements 932 and 934 are each longitudinally tapered such that they are vertically thickest in a direction towards front end 910 and rear end 912 respectively. Distal ends of connecting elements 928 and 930 define through-openings operable to receive fasteners to fasten said distal ends of connecting elements 928 and 930 to gliding device 902. Binding plate 908 defines four through-openings operable to receive fasteners to fasten binding plate 908 to gliding device 902 so that binding plate 908 is fixed in a substantially stationary position relatively to gliding device 902 as described in reference to previous embodiments.

One or both of the front end 910 and the rear end 912 of gliding device 902 may be deflected longitudinally in a direction away from gliding surface 918. In response to such longitudinal deflection, the gliding device 902 and one or both connecting elements 928 and 930 curve along different curvatures because the connecting elements 928 and 930 are on the top side 914 of the gliding device 902. Because distal ends of connecting elements 928 and 930 are held in a generally constant position relative to the gliding device 902, such longitudinal deflection of the gliding device 902 causes one or both force transfer elements 932 and 934 to move longitudinally relative to the gliding device 902 in directions 936 and 938 respectively toward the rear end 912 and front end 910 respectively. For example, if force transfer element 932 moves in the direction 936, the binding plate 910 contacts a top side of force transfer element 932. Binding plate 910 has sufficient rigidity to maintain a generally planar shape, so force transfer element 932 transfers forces to the laterally opposite side elements 922 and 924 toward the gliding surface in generally the same manner as described in reference to previous embodiments. The same can be said for force transfer element 934 if longitudinal deflection of rear end 912 causes wedge element 934 to move in direction 938. Laterally opposite side elements 922 and 924 have sufficient rigidity to transfer such forces longitudinally along at least a portion of the gliding device 902, and in some embodiments, along an entire length of the gliding device 902. As indicated above, the laterally opposite side elements 922 and 924 include respective portions of the gliding surface 918, so that movement of the laterally opposite side elements 922 and 924 in a direction toward gliding surface 918 imparts a concave shape to at least a portion of the gliding surface 918 under binding plate 908, and in some embodiments along the entire length of gliding surface 918, in substantially the same manner as described in reference to previous embodiments.

Figure 24:
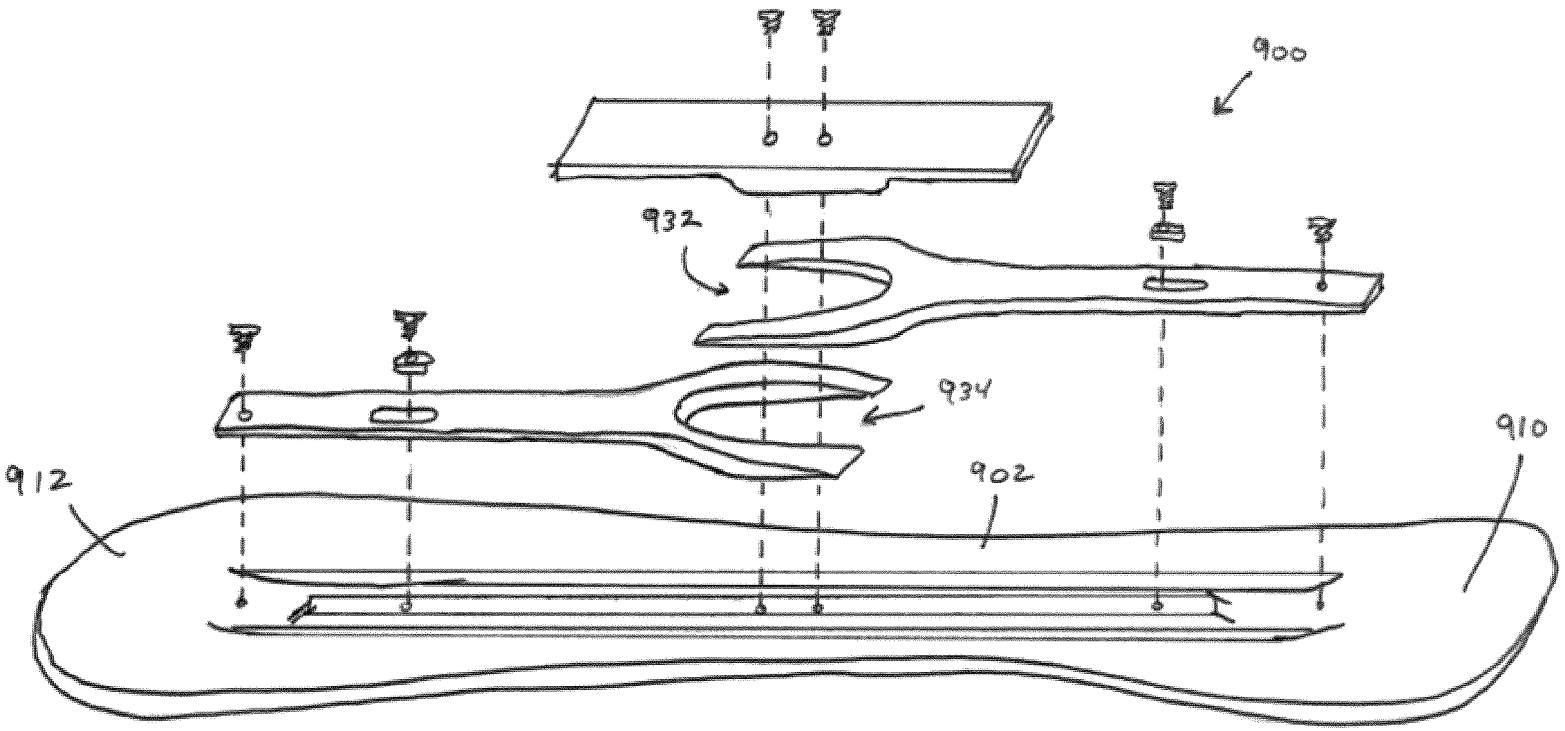
FIG. 24 illustrates a gliding assembly according to another embodiment.
Figure 25:
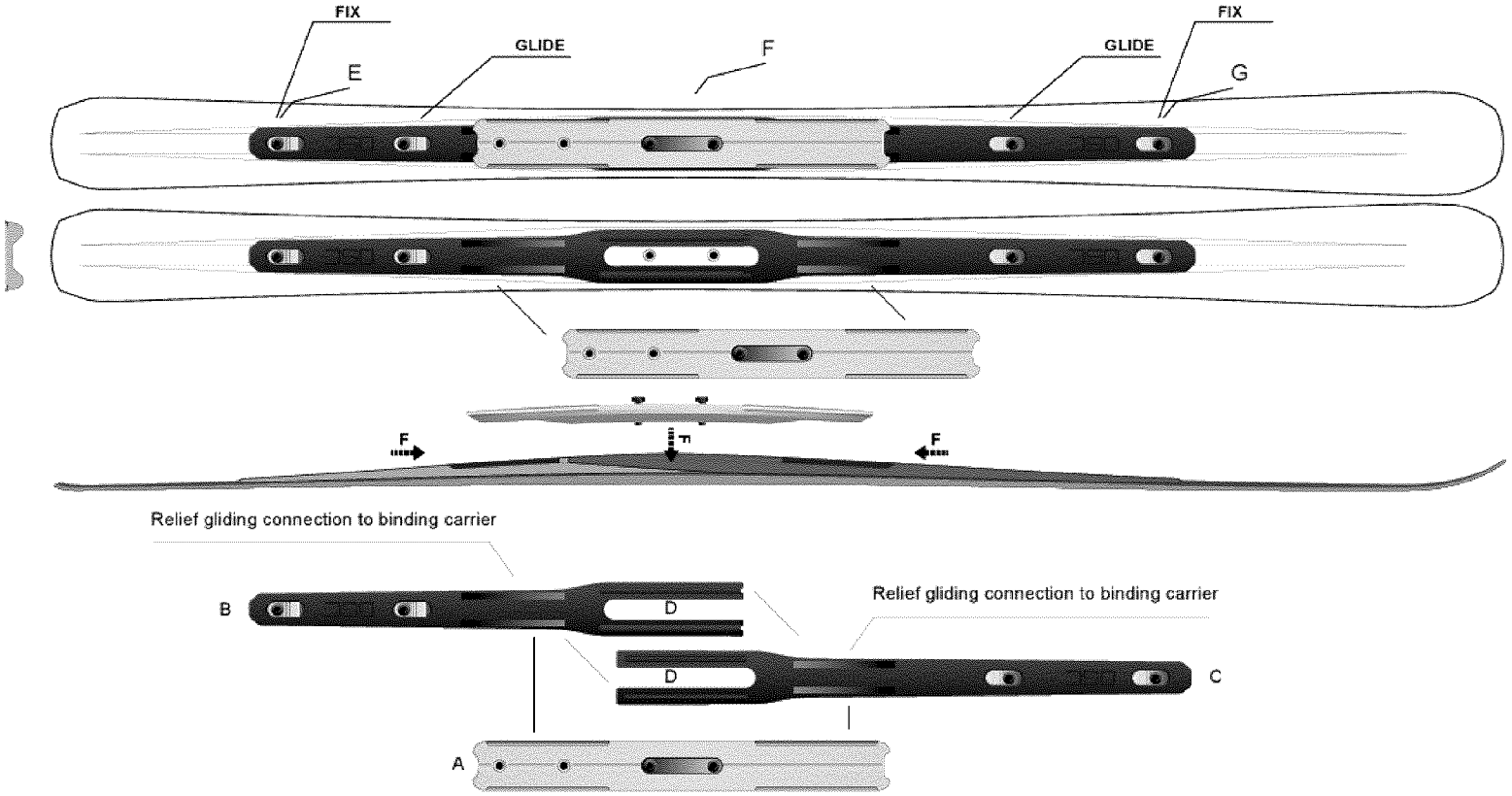
FIG. 25 illustrates a gliding assembly according to another embodiment.

In some embodiments, such as those shown in FIGS. 24 and 25, force transfer elements 932 and 934 may longitudinally overlap such that they slide over one another upon deflection of one or both distal ends 910 and 912 of gliding device 902, which may increase a degree of concavity of gliding surface 918 or increase the magnitude of forces imposed against laterally opposite side elements 922 and 924.

Figure 21:
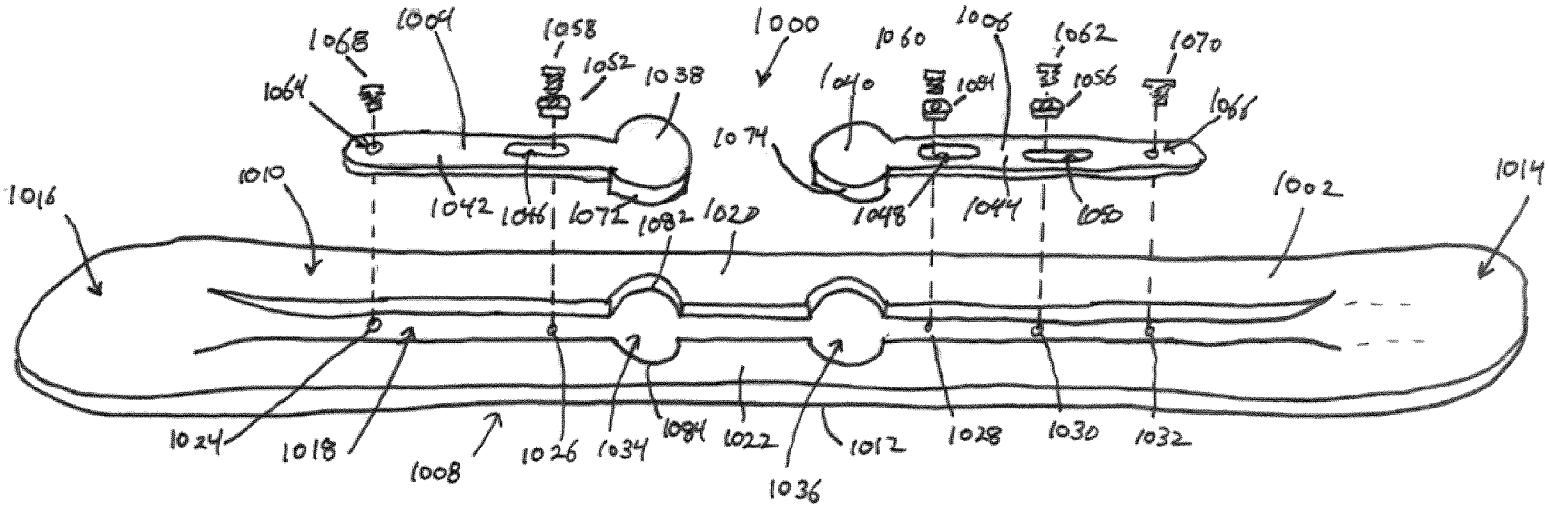

Referring to FIG. 21, a gliding assembly according to another embodiment is shown generally at 1000 and includes a gliding device 1002 and a force transfer bodies 1004 and 1006.

The gliding device 1002 has a bottom side shown generally at 1008 and a top side opposite the bottom side 1008 and shown generally at 1010. The gliding device 1002 has a gliding surface 1012 on the bottom side 1008. The gliding device 1002 has a front end or tip shown generally at 1014 and a rear end shown generally at 1016. On the top side 1010, the gliding device 1002 defines a longitudinal channel shown generally at 1018. The gliding device 1002 includes laterally opposite side elements 1020 and 1022 on opposite lateral sides of the channel 1018. The laterally opposite side elements 1020 and 1022 each include a respective portion of the gliding surface 1012, and the laterally opposite side elements 1020 and 1022 have sufficient rigidity to transfer forces applied to one portion of the laterally opposite side elements 1020 and 1022 longitudinally along the gliding device 1002 as described below. In the channel 1018, the gliding device 1002 defines through-openings shown generally at 1024, 1026, 1028, 1030, and 1032 to receive respective fasteners as described below. Channel 1018 also defines circular cutouts shown generally at 1034 and 1036 sized to receive portions of force transfer bodies 1004 and 1006 as described below.

Force transfer bodies 1004 and 1006 include a force transfer elements 1038 and 1040 and connecting elements 1042 and 1044 integrally formed with the force transfer elements 1038 and 1040 respectively. The force transfer bodies 1038 and 1040 define through-openings shown generally at 1046, 1048, and 1050 sized to receive gliding elements 1052, 1054, and 1056 respectively and fasteners 1058, 1060, and 1062 respectively. Each of through-openings 1046, 1048, and 1050 define a gliding surface positioned to contact the respective one of gliding elements 1052, 1054, and 1056. Force transfer bodies also define through-openings 1064 and 1066 sized to receive fasteners 1068 and 1070 respectively such that the fasteners 1068 and 1070 hold a portion of connecting elements 1042 and 1044 in a generally constant position relative to the gliding device 1002 when the fasteners 1068 and 1070 are received in the through-openings 1024 and 1032 respectively.

When the respective one of fasteners 1058, 1060, and 1062 is fastened in each of through-openings 1046, 1048, and 1050, force transfer elements 1038 and 1040 can slide in a longitudinal direction toward each other and relative to the gliding device 1002 while fasteners 1058, 1060, and 1060 hold the force transfer bodies 1004 and 1006 within the longitudinal channel 1018.

The force transfer elements 1038 and 1040 are circular in shape and define circular projections 1072 and 1074 respectively protruding in a direction toward gliding surface 1012 from an underside of force transfer elements 1038 and 1040 respectively in a direction toward the gliding surface 1012. The force transfer elements 1038 and 1040 have sufficient rigidity to maintain a generally coplanar shape when transferring forces to the laterally opposite side elements 1020 and 1024 as described below.

In some embodiments, the gliding assembly 1000 may include a binding plate (not shown) centered longitudinally and affixed to the assembly generally above force transfer bodies 1004 and 1006 and to which a ski boot or other foot gear may be bound.

Figure 22:
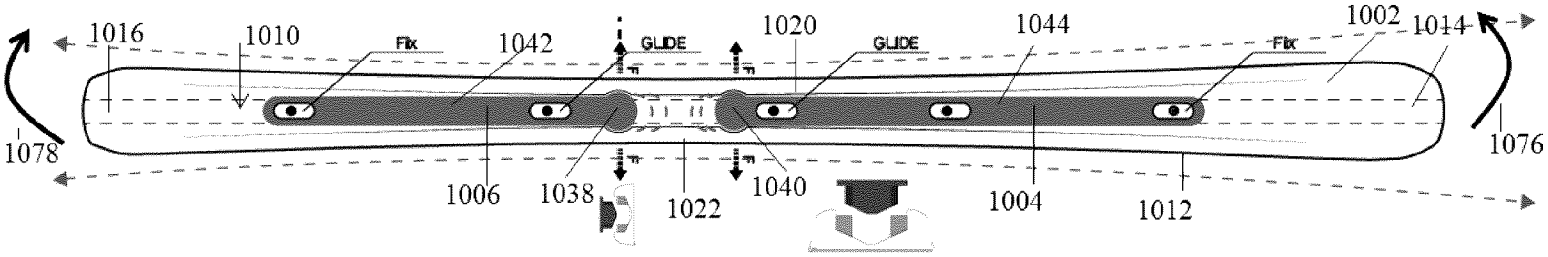

Referring to FIG. 22, when assembled, force transfer elements 1038 and 1040 of gliding assembly 1000 fit into circular cutouts 1034 and 1036 of the gliding device 1002. The front end 1014 of the gliding device 1002 may be deflected longitudinally in a direction 1076. Similarly, the rear end 1016 of the gliding device 1002 may be deflected longitudinally in a direction 1078. The longitudinal deflection of one or both ends is in a direction opposite the gliding surface 1012. In response to such longitudinal deflection, the gliding device 1002 curves along a different curvature as that of one or both of connecting elements 1042 and 1044, because the connecting elements 1042 and 1044 are on the top side 1010 of the gliding device 1002. In response to such longitudinal deflection of one or both distal ends of the gliding device 1002, one or both force transfer elements 1038 and 1040 is caused to move longitudinally relative to the gliding device 1002 in a direction toward the other force transfer element in a substantially similar manner as is described in reference to FIGS. 19-20.

Figure 23:
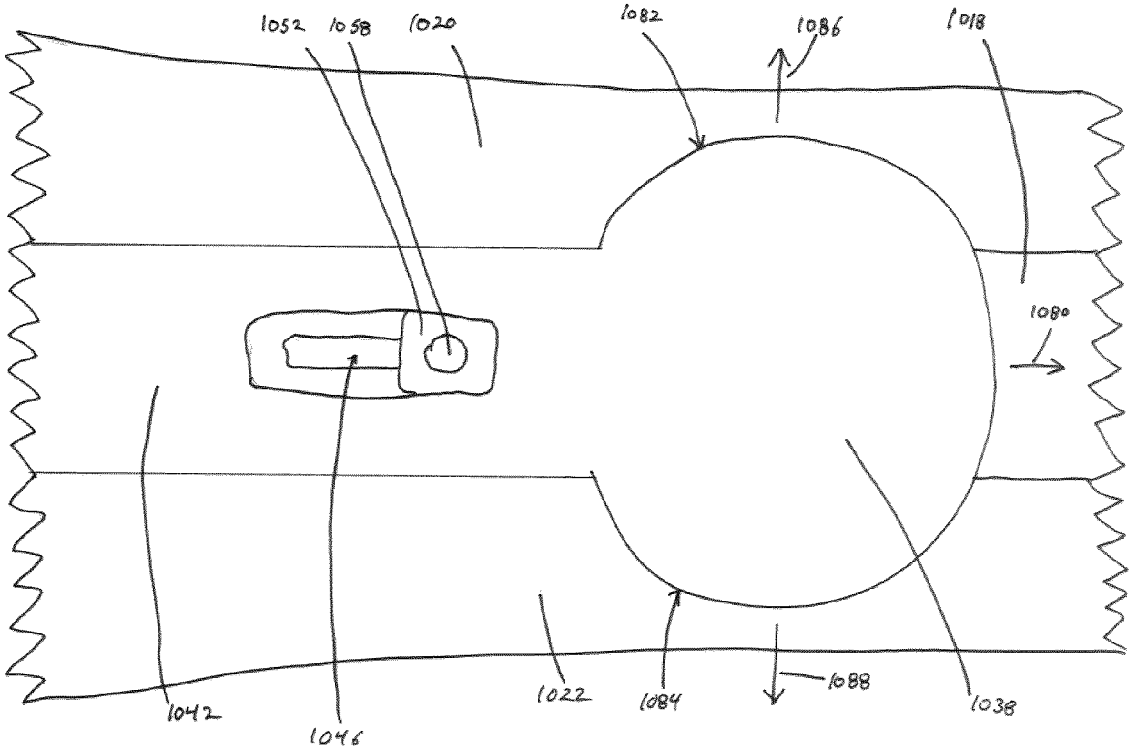
FIGS. 21 to 23 illustrate a gliding assembly according to another embodiment.

FIG. 23 shows a top-down view of force transfer element 1038 and is representative of the function of both force transfer elements 1038 and 1040. When force transfer element 1038 moves longitudinally in a direction 1080, a generally lateral force is imposed on laterally opposite side elements 1020 and 1022 against inner surfaces 1082 and 1084 of circular cutout 1034. As indicated above, the force transfer element 1038 has sufficient rigidity to maintain a generally planar shape, so as the force transfer element 1038 moves in the direction 1080, the circular edge of force transfer element 1038 imparts forces to against inner surfaces 1082 and 1084 in directions 1086 and 1088 being respectively parallel to gliding surface 1012 (not shown). As indicated above, laterally opposite side elements 1020 and 1022 have sufficient rigidity to transfer forces longitudinally along at least a portion of the gliding device 1002. Due to the difference in vertical thickness between laterally opposite side elements 1020 and 1022 and the longitudinal channel 1018 of the sliding body 1002, lateral forces in the directions of 1086 and 1088 cause gliding surface 1012 to assume a laterally concave shape centered about a generally longitudinal axis of gliding device 1002. In some embodiments, forces from the force transfer elements 1038 and 1040 may be transferred along an entire length of the gliding device 1002. The concave shape may therefore be imparted along an entire length of the gliding device 1002 or along a portion of the length of the gliding device 1002, and the concave shape may be imparted at least under a binding region of gliding device 1002.

FIGS. 21 to 23 are also an illustration of an embodiment of lateral homogenous transitional modulation of a gliding surface of a gliding device (such as a ski, for example) using a two-part OSC inverse-operating module that may be integrated and/or flush with a top surface of the ski only at a longitudinal center of the ski. The two-part OSC inverse-operating module of the embodiment of FIGS. 21 to 23 may create concavity at the longitudinal center of the ski using inside profiles of molded top-sheet central shoulders as a lever. Torsional effects may travel from the longitudinal center of the ski to one or both ends of the ski, which may create homogenous transitional concavity. Alternative embodiments of the two-part inverse embodiment of FIGS. 21 to 23 can also apply pressure on tops of the ski shoulders as in other embodiments described herein for example, or in combination with a binding plate to wedge both elements against each other at the longitudinal center of ski.

Figure 26:
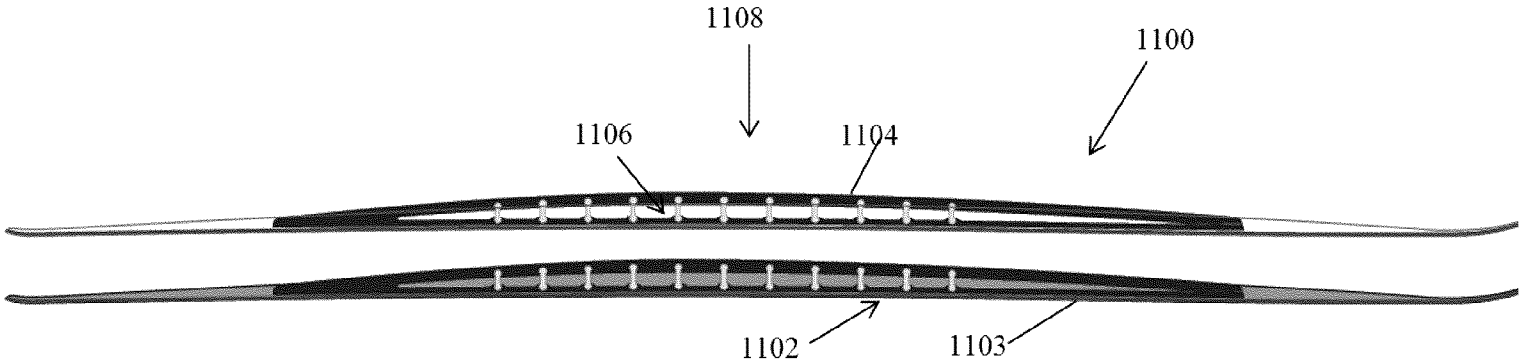
FIGS. 26 and 27 illustrate a gliding assembly according to another embodiment.
Figure 27:
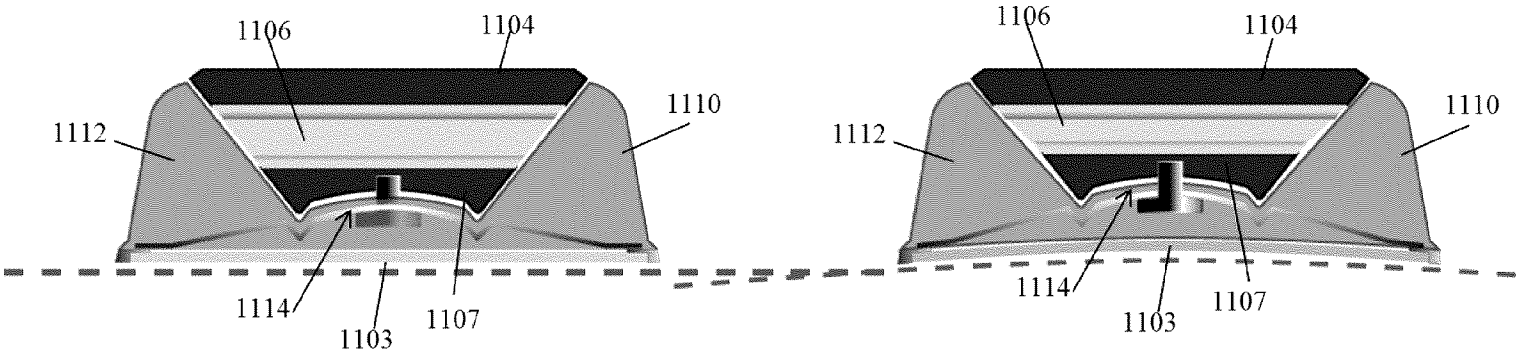

Referring to FIGS. 26 and 27, a gliding assembly in accordance with another embodiment is shown generally at 1100. Gliding assembly 1100 operates on substantially the same principles as those described in reference to other embodiments, and includes a gliding device 1102 defining a bottom gliding surface 1103, a force transfer body 1104, a binding region shown generally at 1108, and a plurality of link bodies shown generally at 1106 operably connecting force transfer body 1104 to a rigid inlay 1107 (shown in FIG. 27) which is fastened to gliding device 1102.

Referring to FIG. 27, gliding device 1102 also defines laterally opposite side elements 1110 and 1112 and a longitudinal channel shown generally at 1114. When a distal end of gliding device 1102 is longitudinally deflected in a direction opposite gliding surface 1103, force transfer body 1104 moves relative to gliding device 1102 for the same reasons as described with reference to previous embodiments. Upon longitudinal movement by force transfer body 1104, the plurality of link bodies 1106, being fixed to force transfer body 1104, also deflect longitudinally to accommodate the movement of force transfer body 1104. Link bodies 1106 are fixed in length, meaning that that as force transfer body 1104 moves longitudinally, link transfer bodies 1106 exert a downward force on force transfer body 1104 toward gliding surface 1103, operably decreasing a vertical distance between force transfer body 1104 and gliding device 1102. The force transfer element 1104 has sufficient rigidity to maintain a generally planar shape. Therefore, as force transfer element 1104 approaches gliding device 1102, force transfer body 1104 exerts generally downward and lateral forces against laterally opposite side elements 1110 and 1112, which in turn cause laterally opposite side elements 1110 and 1112 to move in a downward direction toward gliding surface 1103.

As with previous embodiments, the laterally opposite side elements 1110 and 1112 have sufficient rigidity to transfer forces from the force transfer body 1104 longitudinally along at least a portion of the gliding device 1102, and in some embodiments, along an entire length of the gliding device 1102. The laterally opposite side elements 1110 and 1112 include respective portions of the gliding surface 1103, so that movement of the laterally opposite side elements 1110 and 1112 in the direction toward gliding surface 1103 imparts a concave shape to the gliding surface 1103 as described in reference to previous embodiments. The concave shape may be imparted along an entire length of the gliding device 1102 or along a portion of the length of the gliding device 1102, and the concave shape may be imparted at least along the length of the binding region 1108.

In general, gliding devices such as those described herein may be skis (such as snow skis or water skis) or snowboards, for example. Therefore, gliding devices such as those described herein may include bindings for ski boots or snowboard boots, for example, and such bindings may be attached to portions of the gliding devices between the laterally opposite side elements to allow the laterally opposite side elements to be deflected as described herein.

In embodiments such as those described herein, imparting concave or convex shapes to the gliding surface may cause an increase in rigidity of the gliding device in response to longitudinal deflection of the gliding device. Such increased rigidity when the gliding device is longitudinally deflected may allow the gliding device to have increased stiffness when desired, which may allow an overall reduction in weight of the gliding device. Embodiments such as those described herein do not include discrete longitudinal hinges so that concave or convex shapes imparted to gliding surface may be more smooth or homogenous when compared to gliding devices having longitudinal hinges.

Although specific embodiments have been described and illustrated, such embodiments should be considered illustrative only and not as limiting the invention as construed according to the accompanying claims.

The invention claimed is:

1. An apparatus for changing a shape of a gliding surface of a gliding device, the apparatus comprising:

a force transfer body removably attachable to the gliding device; and at least one force transfer element configured to move longitudinally relative to the force transfer body in response to longitudinal deflection of the force transfer body;

wherein the force transfer body is configured to laterally deflect first and second laterally opposite side elements of the gliding device, along a portion of the gliding device extending longitudinally along a binding region of the gliding device, when the force transfer body is attached to the gliding device and in response to the longitudinal movement of the at least one force transfer element relative to the force transfer body, the apparatus further comprising a first connecting element comprising:

a fixed portion held in a substantially fixed position relative to the force transfer body; and a movable portion coupled to the at least one force transfer element and configured to move longitudinally relative to the force transfer body in response to longitudinal deflection of the force transfer body.

2. The apparatus of claim 1 wherein the fixed and movable portions of the first connecting element are on a same longitudinal side of the binding region of the gliding device when the force transfer body is attached to the gliding device.

3. The apparatus of claim 1 further comprising a second connecting element comprising first and second portions, wherein:

the movable portion of the first connecting element is coupled to the first portion of the second connecting element; and the at least one force transfer element is coupled to the second portion of the second connecting element and is closer to the binding region of the gliding device than the first portion of the second connecting element when the force transfer body is attached to the gliding device.

4. The apparatus of claim 1 wherein the at least one force transfer element is configured to cause the first and second laterally opposite side elements to move laterally away from each other when the force transfer body is attached to the gliding device and in response to the longitudinal movement of the at least one force transfer element relative to the force transfer body.

5. A gliding apparatus comprising:

the apparatus of claim 1; and the gliding device, wherein the force transfer body is attached to the gliding device.

6. The gliding apparatus of claim 5 wherein:

causing the at least one force transfer element to deflect the first and second laterally opposite side elements comprises causing the first and second laterally opposite side elements to move laterally towards each other;

the at least one force transfer element comprises first and second tapered surfaces extending acutely and laterally relative to a longitudinal axis of the gliding device on laterally opposite sides of the at least one force transfer element, wherein the at least one force transfer element is configured to maintain a generally constant separation distance between the first and second tapered surfaces;

the gliding device comprises a third tapered surface extending acutely and laterally relative to the longitudinal axis of the gliding device, wherein the gliding device is configured to transfer a force from the third tapered surface to the first laterally opposite side element;

the gliding device comprises a fourth tapered surface extending acutely and laterally relative to the longitudinal axis of the gliding device, wherein the gliding device is configured to transfer a force from the fourth tapered surface to the second laterally opposite side element; and the at least one force transfer element is configured to move the first tapered surface along and in contact with the third tapered surface and to move the second tapered surface along and in contact with the fourth tapered surface and in response to the longitudinal movement of the at least one force transfer element relative to the gliding device.

7. The gliding apparatus of claim 5 wherein:

causing the at least one force transfer element to deflect the first and second laterally opposite side elements comprises causing the first and second laterally opposite side elements to move laterally away from each other;

the at least one force transfer element comprises first and second tapered surfaces extending acutely and laterally relative to a longitudinal axis of the gliding device on laterally opposite sides of the at least one force transfer element, wherein the at least one force transfer element is configured to maintain a generally constant separation distance between the first and second tapered surfaces;

the gliding device comprises a third tapered surface extending acutely and laterally relative to the longitudinal axis of the gliding device, wherein the gliding device is configured to transfer a force from the third tapered surface to the first laterally opposite side element;

the gliding device comprises a fourth tapered surface extending acutely and laterally relative to the longitudinal axis of the gliding device, wherein the gliding device is configured to transfer a force from the fourth tapered surface to the second laterally opposite side element; and the at least one force transfer element is configured to move the first tapered surface along and in contact with the third tapered surface and to move the second tapered surface along and in contact with the fourth tapered surface and in response to the longitudinal movement of the at least one force transfer element relative to the gliding device.

8. The gliding apparatus of claim 5 wherein:

the first laterally opposite side element comprises a first portion of a force transfer body integrally formed in the gliding device; and the second laterally opposite side element comprises a second portion of the force transfer body.

9. The gliding apparatus of claim 5 wherein:

the first laterally opposite side element comprises a first portion of a force transfer body removably attachable to the gliding device; and the second laterally opposite side element comprises a second portion of the force transfer body.

10. The gliding apparatus of claim 5 wherein the fixed and movable portions of the first connecting element are on a same longitudinal side of the binding region of the gliding device.

11. The gliding apparatus of claim 10 wherein the fixed portion of the first connecting element is closer to the binding region of the gliding device than the movable portion of the at least one connecting element.

12. The gliding apparatus of claim 5 wherein the at least one force transfer element is configured to cause the first and second laterally opposite side elements to move in a direction toward the gliding surface relative to a portion of the gliding device between the first and second laterally opposite side elements in response to the longitudinal movement of the at least one force transfer element relative to the gliding device.

13. The gliding apparatus of claim 12 wherein:

the gliding device comprises first and second tapered surfaces extending acutely relative to the portion of the gliding device between the first and second laterally opposite side elements and configured to maintain a generally constant separation distance from the portion of the gliding device between the first and second laterally opposite side elements; and the at least one force transfer element is configured to, in response to moving longitudinally relative to the gliding device:

move along and in contact with the first tapered surface and thereby transfer a force to the first laterally opposite side element; and move along and in contact with the second tapered surface and thereby transfer a force to the second laterally opposite side element.

14. The gliding apparatus of claim 12 wherein the at least one force transfer element is configured to vary a separation distance between the at least one force transfer element and the portion of the gliding device between the first and second laterally opposite side elements in response to moving longitudinally relative to the gliding device.

15. A gliding apparatus comprising:

a gliding device comprising:

a gliding surface; and first and second laterally opposite side elements, each comprising a respective portion of the gliding surface; and at least one force transfer element configured to move longitudinally relative to the gliding device in response to longitudinal deflection of the gliding device;

wherein the at least one force transfer element is configured to laterally deflect the first and second laterally opposite side elements of the gliding device, along a portion of the gliding device extending longitudinally along a binding region of the gliding device, in response to the longitudinal movement of the at least one force transfer element relative to the gliding device;

wherein the at least one force transfer element is configured to cause the first and second laterally opposite side elements to move in a direction toward the gliding surface relative to a portion of the gliding device between the first and second laterally opposite side elements in response to the longitudinal movement of the at least one force transfer element relative to the gliding device;

wherein the at least one force transfer element is configured to vary a separation distance between the at least one force transfer element and the portion of the gliding device between the first and second laterally opposite side elements in response to moving longitudinally relative to the gliding device;

wherein the at least one force transfer element comprises a tapered surface extending acutely relative to the portion of the gliding device between the first and second laterally opposite side elements; and wherein the tapered surface is configured to move along and in contact with a contact surface having a substantially fixed position relative to the portion of the gliding device between the first and second laterally opposite side elements in response to longitudinally movement of the at least one force transfer element relative to the gliding device to vary the separation distance between the at least one force transfer element and the portion of the gliding device between the first and second laterally opposite side elements in response to moving longitudinally relative to the gliding device.

16. A gliding apparatus comprising:

a gliding device comprising:

a gliding surface; and first and second laterally opposite side elements, each comprising a respective portion of the gliding surface; and at least one force transfer element configured to move longitudinally relative to the gliding device in response to longitudinal deflection of the gliding device;

wherein the at least one force transfer element is configured to laterally deflect the first and second laterally opposite side elements of the gliding device, along a portion of the gliding device extending longitudinally along a binding region of the gliding device, in response to the longitudinal movement of the at least one force transfer element relative to the gliding device;

the gliding apparatus further comprising a first connecting element comprising:

a fixed portion held in a substantially fixed position relative to the gliding device; and a movable portion coupled to the at least one force transfer element and configured to move longitudinally relative to the gliding device in response to longitudinal deflection of the gliding device;

wherein the fixed and movable portions of the first connecting element are on a same longitudinal side of the binding region of the gliding device; and wherein the fixed portion of the first connecting element is closer to the binding region of the gliding device than the movable portion of the at least one connecting element;

the gliding apparatus further comprises a second connecting element comprising first and second portions wherein:

the movable portion of the first connecting element is coupled to the first portion of the second connecting element; and the at least one force transfer element is coupled to the second portion of the second connecting element and is closer to the binding region of the gliding device than the first portion of the second connecting element.

* * * * *